US010680393B2

(12) United States Patent
Tsai

(10) Patent No.: US 10,680,393 B2
(45) Date of Patent: Jun. 9, 2020

(54) BIDIRECTIONAL DUPLEX ELECTRICAL CONNECTOR HAVING CIRCUIT BOARD AND COMBINATION OF THE BIDIRECTIONAL DUPLEX ELECTRICAL CONNECTOR AND DOCKING ELECTRICAL CONNECTOR

(71) Applicant: Chou Hsien Tsai, New Taipei (TW)

(72) Inventor: Chou Hsien Tsai, New Taipei (TW)

( * ) Notice: Subject to any disclaimer, the term of this patent is extended or adjusted under 35 U.S.C. 154(b) by 0 days.

(21) Appl. No.: 16/125,718

(22) Filed: Sep. 9, 2018

(65) Prior Publication Data

US 2019/0006799 A1 Jan. 3, 2019

Related U.S. Application Data

(62) Division of application No. 14/742,072, filed on Jun. 17, 2015, now Pat. No. 10,074,947.

(51) Int. Cl.

| | |
|---|---|
| ***H01R 13/642*** | (2006.01) |
| ***H01R 24/60*** | (2011.01) |
| ***H01R 27/00*** | (2006.01) |
| ***H01R 12/70*** | (2011.01) |
| ***H01R 13/405*** | (2006.01) |
| *H01R 107/00* | (2006.01) |

(52) U.S. Cl.

CPC ..... *H01R 24/60* (2013.01); *H01R 12/7076* (2013.01); *H01R 13/405* (2013.01); *H01R 27/00* (2013.01); *H01R 2107/00* (2013.01)

(58) Field of Classification Search

CPC ..... H01R 24/60
USPC ..... 439/660, 218
See application file for complete search history.

(56) References Cited

U.S. PATENT DOCUMENTS

| | | | | |
|---|---|---|---|---|
| 6,068,038 | A | 5/2000 | Kawaura | |
| 7,094,086 | B2 * | 8/2006 | Teicher | H01R 27/00 439/173 |
| 7,252,552 | B2 * | 8/2007 | Takimura | H01R 13/6585 439/620.22 |
| 7,537,471 | B2 * | 5/2009 | Teicher | H01R 13/64 439/172 |

(Continued)

FOREIGN PATENT DOCUMENTS

| | | | |
|---|---|---|---|
| CN | 1855646 | A | 11/2006 |
| CN | 201038524 | Y | 3/2008 |

(Continued)

*Primary Examiner* — Neil Abrams
(74) *Attorney, Agent, or Firm* — Pro-TECHTOR International Services; Ian Oglesby

(57) ABSTRACT

A bidirectional duplex electrical connector includes: a circuit board, which is provided with two sets of circuits; a base seat; a connection portion connected to a front end of the base seat, and provided with top and bottom surfaces respectively provided with two connection interfaces including two rows of electrical connection points electrically connected to the two sets of circuits, one pair of electrical connection points with a same circuit are electrically connected together through the circuit board, and a shape of the connection portion allows one docking electrical connector to be dual-positionally and bidirectionally docked; and a fitting slot provided on the base seat. The circuit board is fit with and locks the fitting slot. A combination of the bidirectional duplex electrical connector and a docking electrical connector is also provided.

30 Claims, 21 Drawing Sheets

(56) References Cited

U.S. PATENT DOCUMENTS

| | | | | |
|---|---|---|---|---|
| 7,601,010 | B1 * | 10/2009 | Wu | H01R 12/62 439/466 |
| 7,625,245 | B1 * | 12/2009 | Yao | H01R 13/50 439/607.4 |
| 7,717,717 | B1 * | 5/2010 | Lai | H01R 13/64 439/66 |
| 8,182,283 | B2 * | 5/2012 | Chang | H01R 12/724 439/541.5 |
| 8,198,563 | B2 * | 6/2012 | Tsai | H01R 23/10 218/118 |
| 8,573,995 | B2 * | 11/2013 | Golko | H01R 13/516 439/218 |
| 8,647,156 | B2 * | 2/2014 | Golko | H01R 24/60 439/668 |
| 8,979,594 | B2 * | 3/2015 | Tsai | H01R 13/6658 439/660 |
| 8,998,632 | B2 * | 4/2015 | Golko | H01R 13/516 439/345 |
| 9,065,231 | B2 * | 6/2015 | Cho | H01R 24/62 |
| 9,142,926 | B2 * | 9/2015 | Tsai | H01R 24/60 |
| 9,287,668 | B2 * | 3/2016 | Chen | H01R 24/62 |
| 9,350,125 | B2 * | 5/2016 | Jones | H01R 24/60 |
| 9,960,551 | B2 * | 5/2018 | Tsai | H01R 13/642 |
| 10,074,947 | B2 * | 9/2018 | Tsai | H01R 24/60 |
| 2007/0243726 | A1 | 10/2007 | Trenne | |
| 2008/0119076 | A1 | 5/2008 | Teicher | |
| 2008/0218799 | A1 | 9/2008 | Hiew et al. | |
| 2008/0274633 | A1 | 11/2008 | Teicher | |
| 2010/0279520 | A1 * | 11/2010 | Tsai | H01R 13/6658 439/62 |
| 2014/0206209 | A1 * | 7/2014 | Kamei | H01R 24/60 439/81 |
| 2018/0309241 | A1 * | 10/2018 | Tsai | H01R 27/00 |

FOREIGN PATENT DOCUMENTS

| | | | |
|---|---|---|---|
| CN | 201038533 | Y | 3/2008 |
| CN | 101227046 | | 7/2008 |
| CN | 201113091 | Y | 9/2008 |
| CN | 201113094 | Y | 9/2008 |
| CN | 201117922 | Y | 9/2008 |
| CN | 201181784 | Y | 1/2009 |
| CN | 101364678 | A | 2/2009 |
| CN | 201204298 | Y | 3/2009 |
| CN | 201378641 | Y | 1/2010 |
| CN | 201478490 | U | 5/2010 |
| CN | 201478491 | U | 5/2010 |
| CN | 201490374 | U | 5/2010 |
| JP | 2003217728 | A | 7/2003 |
| KR | 1020070039956 | A | 4/2004 |
| TW | M253969 | | 12/2004 |
| TW | M303513 | | 12/2006 |
| TW | 200814468 | | 3/2008 |

* cited by examiner

BIDIRECTIONAL DUPLEX ELECTRICAL CONNECTOR HAVING CIRCUIT BOARD AND COMBINATION OF THE BIDIRECTIONAL DUPLEX ELECTRICAL CONNECTOR AND DOCKING ELECTRICAL CONNECTOR

This application is a Divisional Application of U.S. patent application Ser. No. 14/742,072, filed on Jun. 17, 2015, now issued as U.S. Pat. No. 10,074,947 B2 on Sep. 11, 2018.

BACKGROUND OF THE INVENTION

Field of the Invention

The invention relates to an electrical connector, and more particularly to an electrical connector for bidirectionally electrical connections.

Related Art

The universal serial bus (USB) is the most popular signal transmission specification in the modern computer apparatus. The connector socket and the transmission cable satisfying this specification can make the peripheral apparatus, such as a mouse, a keyboard or the like, which is externally connected to the computer, be immediately plugged and played.

At present, the USB 2.0 and USB 3.0 specifications are used. As shown in FIG. 1, the conventional USB 2.0 male plug 90 includes a plastic base 91 and a metal housing 92. The metal housing 92 covers the plastic base 91, and a connection space 93 is formed between the metal housing 92 and the plastic base 91. Only one surface of the plastic base 91 is formed with one row of connection points 94 exposed to the connection space 93. At present, the specifications specified by the USB Society are listed in the following. The overall height "i" is equal to 4.5 mm, the half height "j" corresponding to the connection space 93 is equal to 2.25 mm, and the height "k" of the connection space is equal to 1.95 mm.

At present, one surface of the tongue of the USB 2.0 socket has one row of connection points. In use, the USB 2.0 plug has to be correctly inserted so that the connection points of the plug and the socket can be aligned and electrically connected together. In order to ensure the electrical connection to be established when the USB plug is inserted, mistake-proof designs, as shown in FIG. 1A, are provided on the socket and the plug. The normal direction corresponds to the mark 97, formed on one surface of the handle 96 connected to the USB 2.0 male plug 90, facing upwards. At this time, the connection point 94 faces upwards. When the plug is inserted in the normal direction, the plug can be electrically connected to the socket. As shown in FIG. 1B, the USB plug cannot be reversely inserted into the socket, so that the electrical connection after the insertion can be ensured. The user usually randomly inserts the plug into the socket, so the possibility of failing to insert the plug is equal to ½. So, the user usually has to insert the plug twice, and the inconvenience in use is caused.

As shown in FIG. 2, the conventional USB 2.0 socket 80 includes a plastic base 81, a metal housing 83 and one row of terminals 87. The front end of the plastic base 81 is integrally formed with a horizontally extending tongue 82. The metal housing 83 is positioned at the front end of the plastic base 81 to form a connection slot 84. The tongue 82 is located at the lower section of the connection slot 84. The one row of four terminals 87 is fixed to the plastic base 81, extends frontwards and is arranged on the tongue 82. A projecting connection point 88 is formed near a distal end of the terminal 87.

In order to match with the mistake-proof design of the male plug, the USB socket 80 has the following dimensions. The height "o" of the connection slot is equal to 5.12 mm; the thickness "p" of the tongue is equal to 1.84 mm; the height "s" above the tongue is equal to 0.72 mm; and the height "q" below the tongue is equal to 2.56 mm Thus, the USB 2.0 male plug 90 has to be inserted with the connection point 94 facing downwards, so that the connection space 93 and the tongue 82 are fit and positioned with each other. The half height "j" (2.25 mm) is fit with the height "q" (2.56 mm) below the tongue. The reverse USB male plug 90 cannot be inserted. In addition, the horizontal distance "t" from the insert end 86 of the positioning plane of the connection slot 84 to the first connection point 88 of the first terminal is equal to 3.5 mm.

When the USB 2.0 male plug 90 is inserted into the USB socket 80, the plug 90 and the socket 80 are tightly fit with each other according to the height "k" (1.95 mm) of the connection space and the thickness "p" (1.84 mm) of the tongue.

As shown in FIG. 2A, the conventional USB 3.0 socket 85 has the structure and associated dimensions, which are substantially the same as those of the USB 2.0 socket 80 except that the tongue 82 of the USB 3.0 socket 85 is longer and the front section thereof is formed with one row of five second connection points 89, which cannot be elastically moved. In addition, the horizontal distance "t" from the insert end 86 of the positioning plane of the connection slot 84 to the first connection point 88 of the first terminal is equal to 4.07 mm.

The structure and the associated dimensions of the USB 3.0 male plug are substantially the same as those of the USB 2.0 socket 80 except that the USB 3.0 plug additionally has one row of five connection points, which project beyond the connection space and can be elastically moved.

The conventional USB socket, either the USB 2.0 or 3.0 socket only has the contact pattern formed on one single surface, and thus cannot allow the bidirectional insertion and connection. However, if the USB socket is designed to allow the bidirectional insertion and connection, the connection points of the terminals have to be formed on two surfaces of the tongue, the positioning of the bidirectionally inserted USB male plug has to be ensured, and the four terminals 87 cannot be short-circuited. When the USB male plug is inserted and its metal housing touches the connection points 88 of the terminals 87 on one surface of the tongue, the short circuit is caused to damage the USB socket. Due to the above-mentioned problems, the manufacturers have encountered the bottleneck in developing this product.

The applicant has paid attention to the research and development of the bidirectionally inserted and connected USB socket and finally provides the improved structure to overcome the above-mentioned problems and the pattern of the tongue for the USB 3.0 socket.

The characteristics and structures of this divisional application are mainly disclosed in FIGS. 21 to 32, and FIGS. 39, 40 and 47.

SUMMARY OF THE INVENTION

A main object of the invention is to provide a bidirectional duplex electrical connector provided with a circuit board so that at least one pair of electrical connection points of two rows of electrical connection points with a same circuit are electrically connected together through the circuit board.

Another main object of the invention is to provide a bidirectional duplex electrical connector, wherein front and rear sections of two surfaces of a tongue are configured as lower surfaces and upper surfaces with steps formed therebetween, so that upper and lower connection surfaces with steps formed therebetween are formed to provide the better bidirectional electrical connection.

Another main object of the invention is to provide a bidirectional duplex electrical connector, which is provided with a fitting slot, wherein a circuit board can be fit with and lock the fitting slot.

Another main object of the invention is to provide a bidirectional duplex electrical connector, wherein two surfaces of the rear section of the tongue are two high surfaces, two surfaces of the front section of the tongue are two low surfaces, and a side view of the tongue has a convex shape.

Another main object of the invention is to provide a bidirectional duplex electrical connector, wherein two surfaces of a rear section of a tongue are in forms of upper surfaces, two surfaces of a front section of the tongue are in forms of lower surfaces, so that the tongue has the higher structural strength.

Another object of the invention is to provide a bidirectional duplex electrical connector having a tongue with a thick rear portion and a thinner front portion to enhance the structural strength.

Another object of the invention is to provide a bidirectional duplex electrical connector provided with a circuit board, which is provided with a safety protection circuit to achieve circuit safety.

To achieve the above-identified object, the invention provides a bidirectional duplex electrical connector, including: a circuit board provided with two sets of circuits, wherein the circuit board is provided with one or multiple rows of bonding points, and the one or multiple rows of bonding points are electrically connected to the two sets of circuits; a base seat; and a connection portion disposed on a front end of the base seat, wherein the connection portion is provided with top and bottom surfaces, multiple front sections of the top and bottom surfaces of the connection portion are provided with lower two low surfaces, multiple rear sections of the top and bottom surfaces of the connection portion are higher two high surfaces and closer to the base seat than the front sections, the high surface of one of the top and bottom surfaces of the connection portion is higher than the low surface of the one of the top and bottom surfaces of the connection portion to form a step between the high surface and the low surface of the one of the top and bottom surfaces, each of the top and bottom surfaces is provided with a connection interface, each of the two connection interfaces includes one row of electrical connection points, the one row of electrical connection points are disposed on one of the high and low surfaces, the two rows of electrical connection points are respectively electrically connected to the two sets of circuits of the circuit board, at least one pair of electrical connection points of the two rows of electrical connection points with a same circuit are electrically connected together through the circuit board, and a shape of the connection portion allows one docking electrical connector to be dual-positionally and bidirectionally docked for positioning.

The invention further provides a bidirectional duplex electrical connector, including: a circuit board, wherein the circuit board is provided with two sets of circuits, a rear section of the circuit board is provided with one or multiple rows of bonding points, and the one or multiple rows of bonding points are electrically connected to the two sets of circuits; a base seat; a connection portion, wherein the connection portion is connected to and disposed on a front end of the base seat, the connection portion is provided with top and bottom surfaces, each of the top and bottom surfaces is provided with a connection interface, each of the two connection interfaces includes one row of electrical connection points, the two rows of electrical connection points are respectively electrically connected to the two sets of circuits of the circuit board, at least one pair of electrical connection points of the two rows of electrical connection points with a same circuit are electrically connected together through the circuit board, and a shape of the connection portion allows one docking electrical connector to be dual-positionally and bidirectionally docked for positioning; and a fitting slot provided on the base seat, wherein the circuit board is fit with and locks the fitting slot, and the one or multiple rows of bonding points are exposed out of the fitting slot.

The invention further provides a bidirectional duplex electrical connector, including: a circuit board provided with two sets of circuits, wherein the circuit board is provided with one or multiple rows of bonding points, and the one or multiple rows of bonding points are electrically connected to the two sets of circuits; a base seat; and a tongue, wherein the tongue is provided on a front end of the base seat, a front section and a rear section of top and bottom surfaces of the tongue are flat surfaces, each of the top and bottom surfaces of the tongue is provided with a connection interface, each of the two connection interfaces includes one row of electrical connection points, the two rows of electrical connection points are respectively arranged and exposed, and in flat surface contact with and fixed to and only provided on top and bottom flat surfaces of the front section of the tongue, the two rows of electrical connection points are respectively electrically connected to the two sets of circuits of the circuit board, at least one pair of electrical connection points of the two rows of electrical connection points with a same circuit are electrically connected together through the circuit board, and a shape of the tongue allows one docking electrical connector to be dual-positionally and bidirectionally docked for positioning.

wherein the circuit board is provided with a safety protection circuit, the safety protection circuit is electrically connected to at least one pair of electrical connection points of the two rows of electrical connection points, and the safety protection circuit is provided with a circuit safety protection device and/or multiple safety circuit electrical elements to achieve circuit safety.

With the above-mentioned structure, the following advantages can be achieved.

1. The upper and lower connection surfaces may be disposed on the front and rear sections of the two surfaces of the two surfaces of the tongue with a step formed therebetween, thereby providing the better bidirectional electrical connection. In addition, the two surfaces of the rear section of the tongue are in the forms of upper surfaces, and the two surfaces of the front section of the tongue are in the forms of lower surfaces, so that the tongue structure has the better strength.

2. The invention is provided with a circuit board so that at least one pair of electrical connection points of two rows of electrical connection points with a same circuit are electrically connected together through the circuit board.

3. The invention is provided with a circuit board, which is provided with a safety protection circuit to achieve circuit safety.

4. The invention is provided with a fitting slot, and a circuit board can be fit with and lock the fitting slot.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE INVENTION

The present invention will be apparent from the following detailed description, which proceeds with reference to the accompanying drawings, wherein the same references relate to the same elements.

Figure 3:
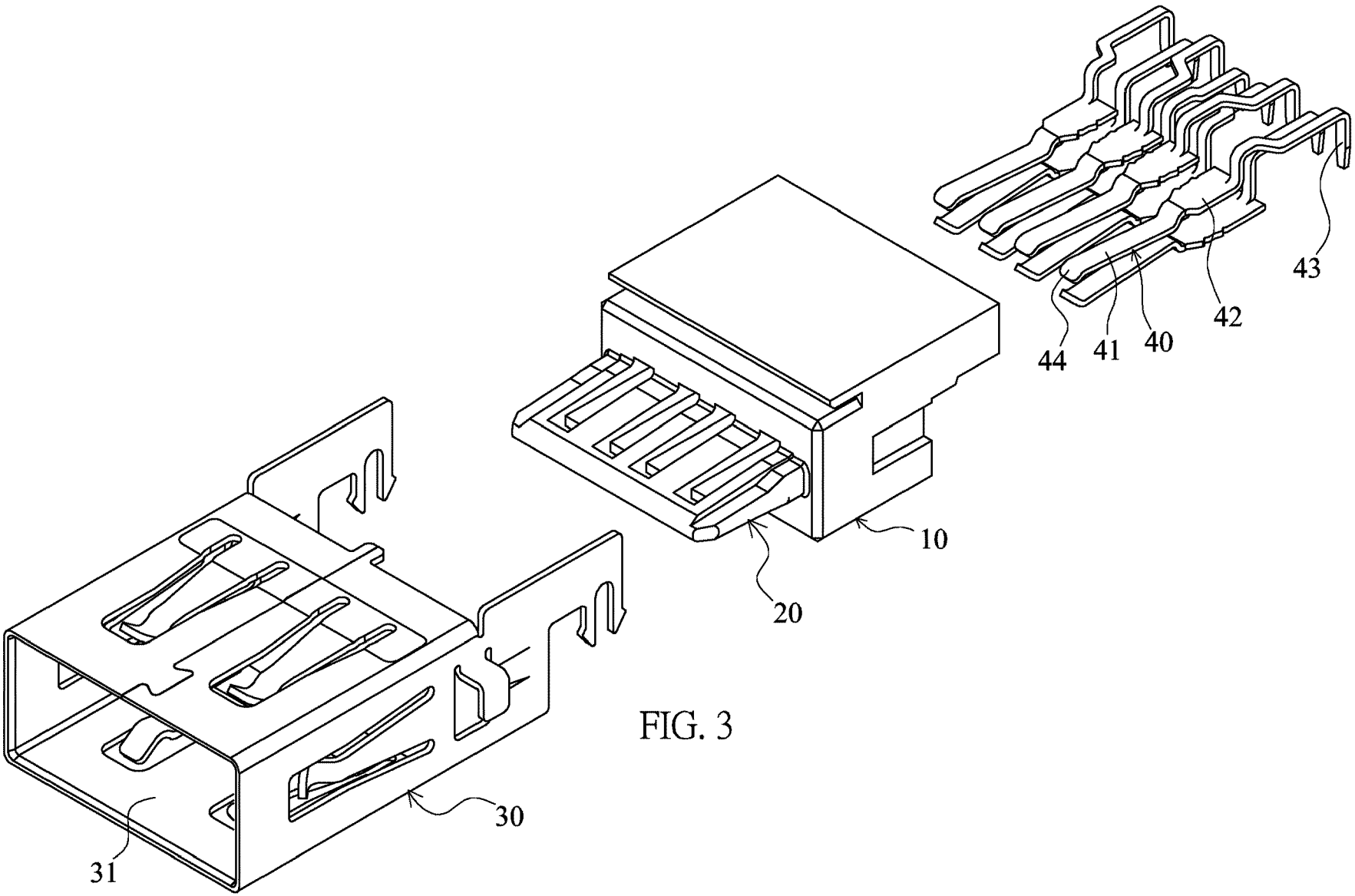
FIG. 3 is a pictorially exploded view showing a first embodiment of the invention.
Figure 4:
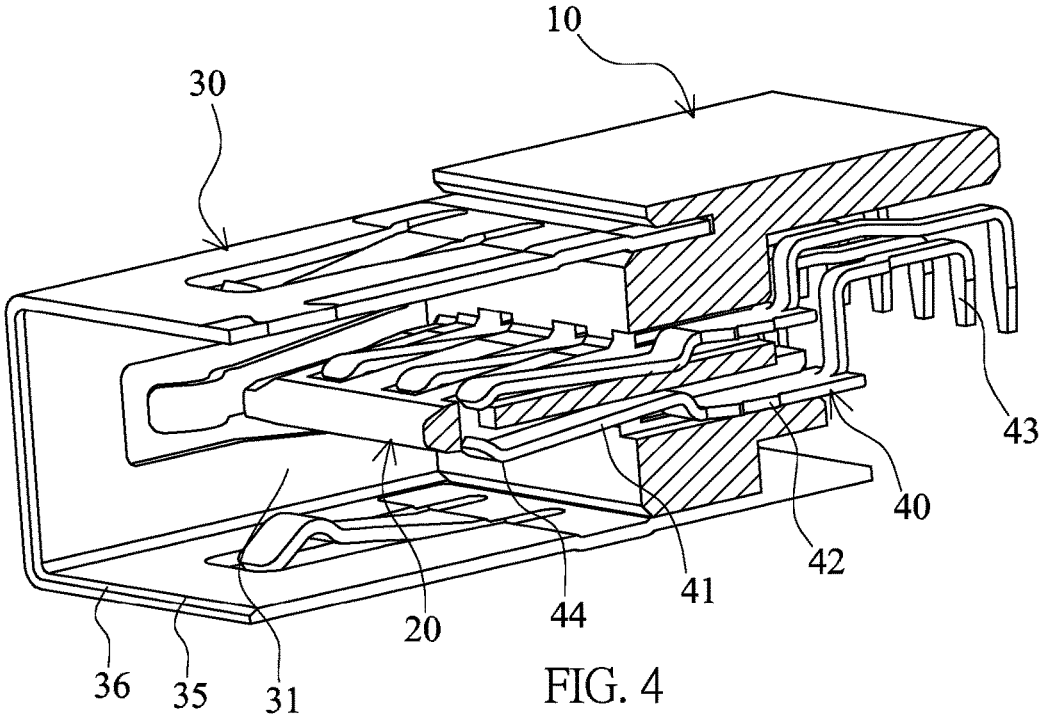
FIG. 4 is a pictorially assembled view showing the first embodiment of the invention.
Figure 5:
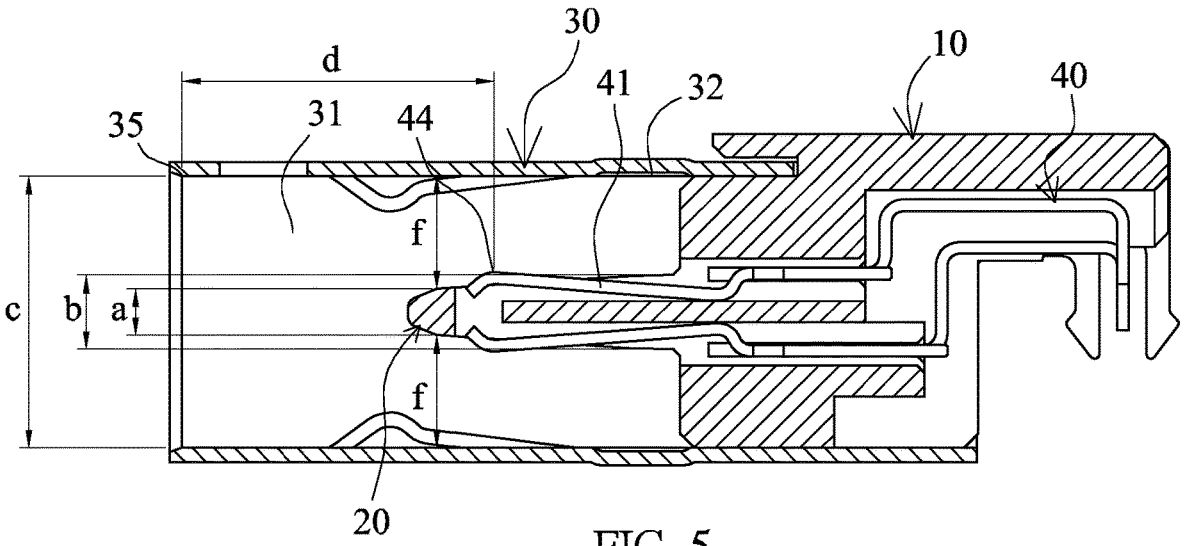
FIG. 5 is a cross-sectional side view showing the first embodiment of the invention.

Referring to FIGS. 3 to 5, the first embodiment of the invention is a USB 2.0 socket, which may be connected to the USB 2.0 male plug 90 and includes a plastic base 10, a tongue 20, a metal casing 30 and two rows of first terminals 40.

The tongue 20 integrally projects beyond the front end of the plastic base 10, and has a thinner front end and a thicker rear end so that it is tapered from rear to front. Thus, the tongue 20 is stronger and cannot be easily broken.

The metal casing 30 is formed with a connection slot 31. The metal casing 30 is disposed at the front end of the plastic base 10 and covers the tongue 20 therein. The top surface and the bottom surface of the rear section of the connection slot 31 are formed with concave surfaces (also referred to as lower surfaces) 32, so that the height of the rear section of the connection slot 31 is greater than that of the insert port. The front end of the connection slot 31 is formed with a guide-in inclined surface 36.

Each row of first terminals 40 has four terminals. The first terminal 40 includes an elastic arm 41, a fixing portion 42 and a pin 43. The fixing portion 42 is positioned within the plastic base 10. The elastic arm 41 extends toward the connection slot 31 and is formed with a projecting first connection point 44 projecting beyond one surface of the tongue 20. The first connection points 44 of the two rows of first terminals 40 respectively project beyond two surfaces of the tongue 20.

The invention is characterized in that the spaces of the connection slot 31 on two surfaces of the tongue 20 allow the USB male plug to be bidirectionally inserted and positioned. In addition, when the USB male plug is inserted into the connection slot 31 and reaches a horizontal position of the first connection point 44 of the first terminal 40 with a maximum inclined angle between the USB male plug and the connection slot 31, a gap between the metal housing of the USB male plug and the first connection point is greater than 0.05 mm to prevent the short circuit.

To satisfy the requirements on the bidirectionally electrical connection and the elimination of the short circuit, the length of the metal casing 30 of this embodiment is longer than that of the prior art, the length of the tongue 20 of this embodiment is shorter than that of the prior art, the first connection point 44 shrinks back and the tongue 20 is thinner than that of the prior art. The designed dimensions are listed in the following. The thickness "a" of the front end of the tongue is about 1 mm, the thickness "b" of the rear end of the tongue is about 1.6 mm, the height "c" of the connection slot is about 5.8 mm, the horizontal distance "d" from the insert end 35 of the positioning plane of the connection slot 31 to the first connection point 44 of the first terminal 40 is about 6.6 mm, and the heights "f" of the spaces beside the two surfaces of the tongue range from about 2.3 mm to 2.4 mm That is, the parameter "f" at the front end of the tongue is equal to (5.8 mm-1 mm)/2=2 4 mm, and is gradually decreased toward the rear end of the tongue. Because the parameter "f" of the rear section of the tongue still has to be greater than 2.3 mm, the concave surface 32 is provided.

The tongue of this embodiment is thinner than that of the prior art, the tongue 20 is configured to be tapered from rear to front in order to enhance the structural strength.

Figure 1:
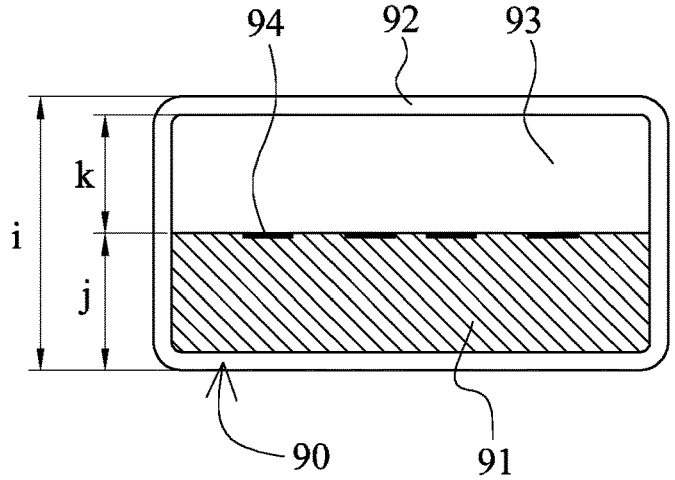
FIG. 1(Prior Art)
FIG. 1 is a cross-sectional front view showing a conventional USB 2.0 male plug.
Figure 1A:
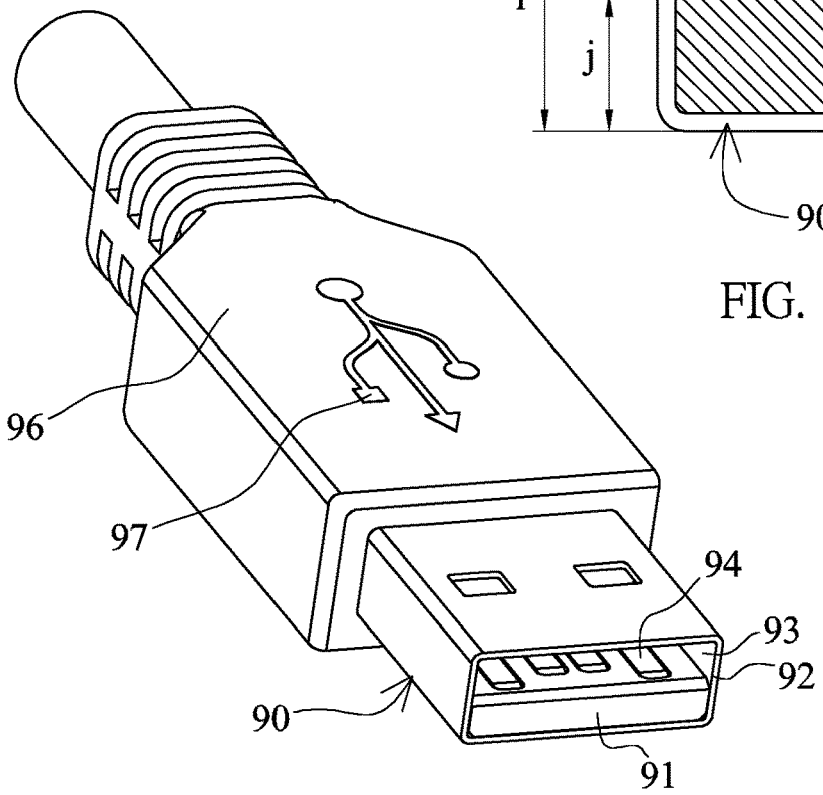
FIG. 1A (Prior Art)
FIG. 1A is a pictorial view showing the conventional USB 2.0 male plug, which is normally inserted and tilts downwards.
Figure 6:
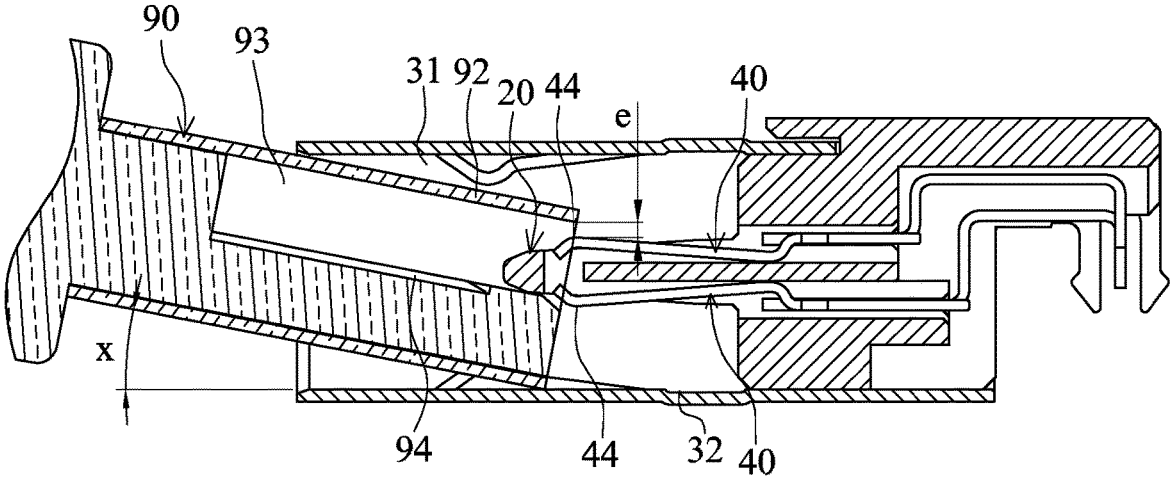
FIG. 6 is a cross-sectional side view showing a usage state of the first embodiment of the invention.
Figure 7:
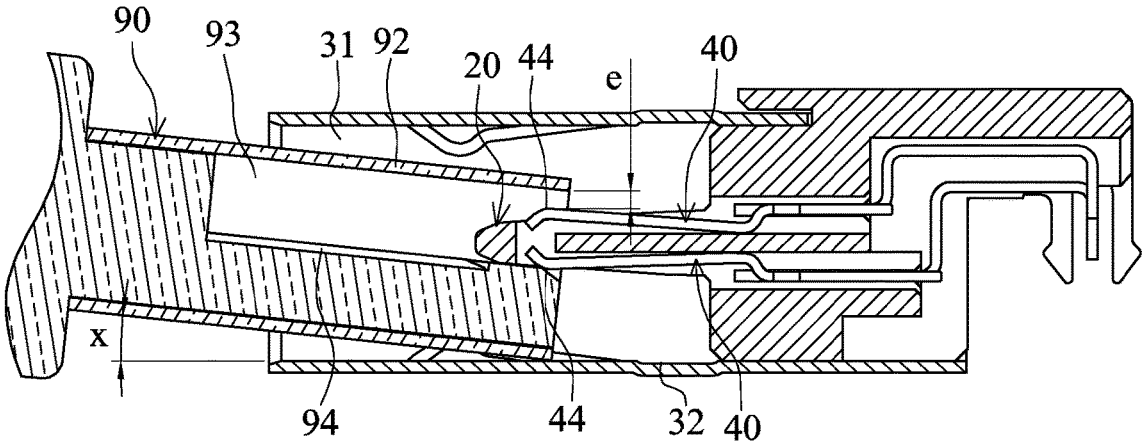
FIG. 7 is a cross-sectional side view showing the usage state of the first embodiment of the invention.
Figure 8:
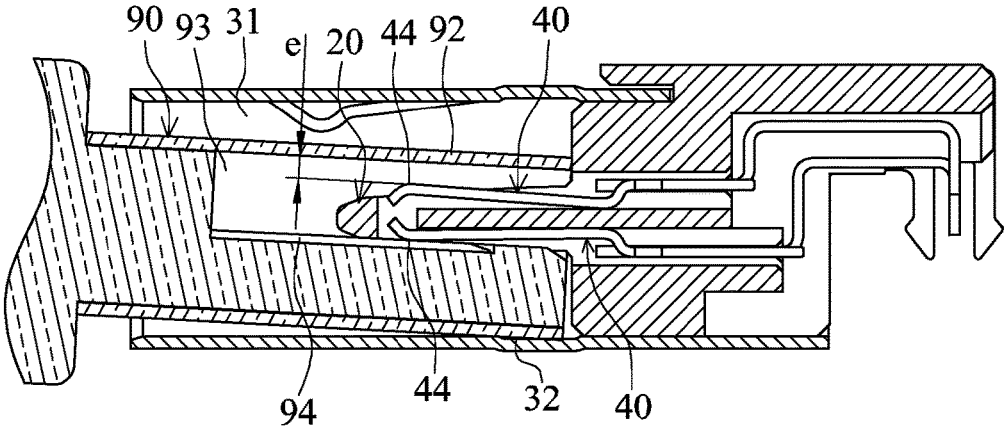
FIG. 8 is a cross-sectional side view showing the usage state of the first embodiment of the invention.

The following operation description illustrates that the metal housing 92 of the USB 2.0 plug 90 cannot touch the first connection point 44 of the first terminal 40 when the USB 2.0 plug 90 is slantingly inserted into the connection slot 31 at any inclined angle. As shown in FIG. 6, the connection point 94 of the USB 2.0 male plug 90 faces upwards and the USB 2.0 male plug 90 is normally inserted into the insert port and tilts downwards (the pictorial view when the USB 2.0 male plug 90 is normally inserted and tilts downwards is illustrated in FIG. 1A). Thus, when the USB 2.0 male plug 90 is inserted into the connection slot 31 and reaches the horizontal position of the first connection point 44 of the first terminal 40 with a maximum inclined angle between the male plug 90 and the connection slot 31, the included angle "x" between the USB 2.0 male plug 90 and the connection slot 31 is about 11.5 degrees, the tongue 20 is accommodated within the connection space 93 of the USB male plug, and the gap "e" between the metal housing 92 and the first connection point 44 on the top surface of the tongue is still greater than 0.3 mm to prevent the short circuit from occurring. As shown in FIG. 7, when the USB 2.0 male plug 90 is further inserted inwards and then gradually rotated to be horizontal, the gap "e" is greater than 0.38 mm, and the included angle "x" between the USB 2.0 male plug 90 and the connection slot 31 is equal to about 6.5 degrees. As shown in FIG. 8, when the USB 2.0 male plug 90 is further inserted inwards to a predetermined position, the connection point 94 of the USB 2.0 male plug 90 touches the first connection point 44 of the first terminal on the bottom surface of the tongue, the gap "e" is greater than 0.48 mm, and the half height (2.25 mm) of the USB 2.0 male plug 90 can be fit and positioned with the space height "f" (2.3 mm to 2.4 mm) below the tongue 20. Although the rear end of the tongue 20 is thicker to decrease the space height "f", the rear section of the connection slot 31 is formed with the concave surface 32 to provide the compensation. Thus, the USB 2.0 male plug 90 still can be inserted into the innermost end for positioning. At this time, the included angle between the USB 2.0 male plug 90 and the bottom surface of the connection slot 31 is equal to about 3 degrees. That is, the USB 2.0 male plug 90 is slantingly positioned within the connection slot 31.

Figure 9:
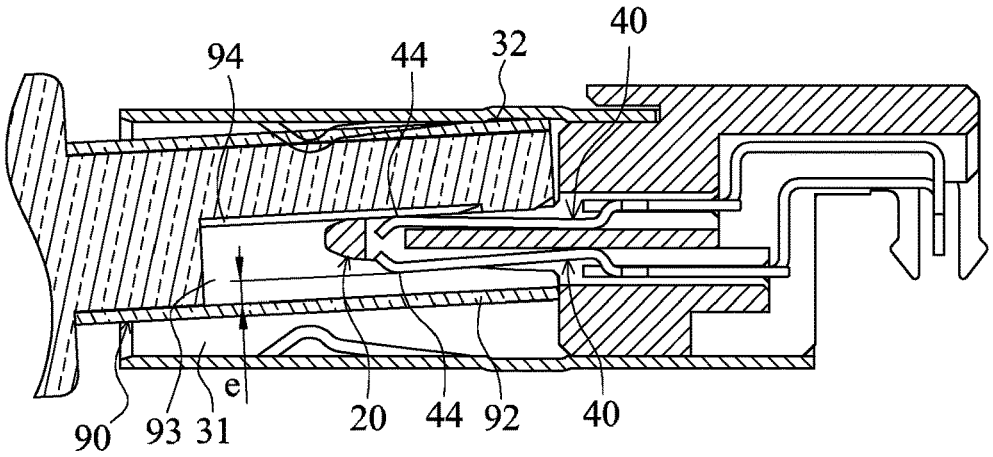
FIG. 9 is a cross-sectional side view showing the usage state of the first embodiment of the invention.

As shown in FIG. 9, the connection point 94 of the USB 2.0 male plug 90 faces downwards and the USB 2.0 male plug 90 is reversely inserted into the positioning state. At this time, the gap "e" is also greater than 0.48 mm, and the half height (2.25 mm) of the USB 2.0 male plug 90 is fit and positioned with the space height "f" (2.3 mm to 2.4 mm) above the tongue 20.

According to the above-mentioned description, it is obtained that, when the USB 2.0 male plug 90 is inserted into the connection slot 31 for positioning, the essential conditions that the metal housing 92 of the USB 2.0 male plug 90 does not touch the first connection point 44 reside in the thickness of the front section of the tongue 20 and the height of the first connection point 44 projecting beyond the front section of the tongue 20. Because the height "k" of the connection space of the USB 2.0 male plug 90 is equal to 1.95 mm and the first connection point 44 must have an elastically movable height of about 0.3 mm, the thickness of the front section of the tongue 20 cannot be greater than 1.55 mm in order to ensure that the metal housing 92 cannot touch the first connection point 44.

However, the user may not insert the plug exactly horizontally. If the insertion angle is too great, then the metal housing 92 of the USB 2.0 male plug 90 touches the first connection point 44 during the insertion process. The design factors affecting the maximum slanting insertion angle of the USB 2.0 male plug 90 reside in the height "c" of the connection slot and the horizontal distance "d" from the insert end 35 of the positioning plane of the connection slot 31 to the first connection point 44 of the first terminal 40. That is, the maximum inclined angle of inserting the USB 2.0 male plug 90 becomes smaller and the gap "e" becomes greater as the height "c" of the connection slot gets smaller and the horizontal distance "d" gets greater. This invention ensures the safety gap "e" by increasing the horizontal distance.

In this invention, the thickness of the tongue, the height "c" of the connection slot and the horizontal distance "d" from the insert end 35 of the positioning plane of the connection slot 31 to the first connection point 44 of the first terminal 40 are properly designed so that a whole new structure is provided for the USB plug to be bidirectionally inserted, connected and positioned without causing the short circuit.

Figure 10:
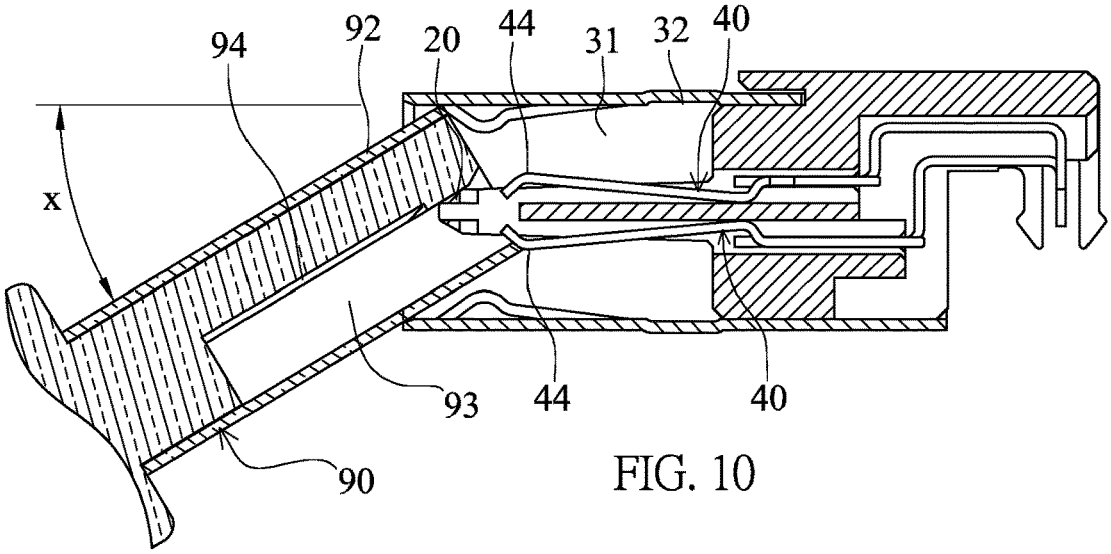
FIG. 10 is a cross-sectional side view showing the usage state of a second embodiment of the invention.

As shown in FIG. 10, the second embodiment of the invention is almost the same as the first embodiment except that the horizontal distance from the insert end of the positioning plane of the connection slot 31 to the first connection point 44 of the first terminal 40 is shorter in this embodiment. When the USB 2.0 male plug 90 is inserted into the connection slot 31 and reaches the horizontal position of the first connection point 44 of the first terminal 40 with the maximum inclined angle between the USB 2.0 male plug 90 and the connection slot 31, the included angle "x" between the USB 2.0 male plug 90 and the connection slot 31 is equal to about 28 degrees, and the metal housing 92 touches the first connection point 44 on the bottom surface of the tongue to cause the short circuit. This is an incorrect embodiment, which mainly illustrates the short-circuited condition.

Figure 11:
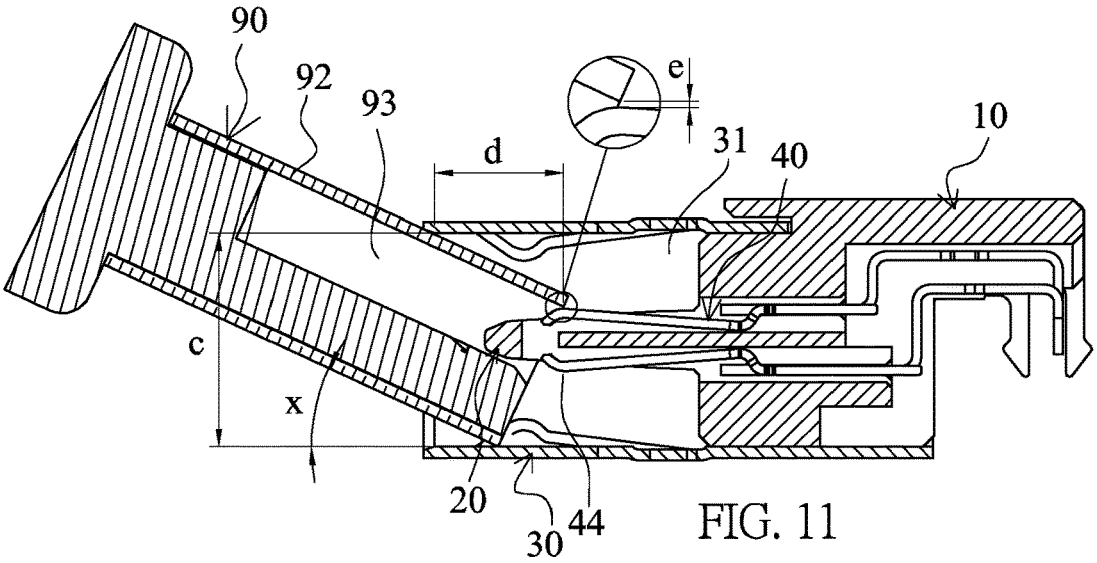
FIG. 11 is a cross-sectional side view showing the usage state of a third embodiment of the invention.

As shown in FIG. 11, the third embodiment of the invention is almost the same as the first embodiment except that the horizontal distance from the insert end of the positioning plane of the connection slot 31 of this embodiment to the first connection point 44 of the first terminal 40 is shorter and equal to about 3.55 mm. When the USB 2.0 male plug 90 is inserted into the connection slot 31 and reaches the horizontal position of the first connection point 44 of the first terminal 40 with the maximum inclined angle between the USB 2.0 male plug 90 and the connection slot 31, the included angle "x" between the USB 2.0 male plug 90 and the connection slot 31 is equal about 24.5 degrees, and the gap "e" between the metal housing 92 and the first connection point 44 on the top surface of the tongue is still greater than 0.05 mm So, the electrical connector still can be used without causing the short circuit.

Figure 12:
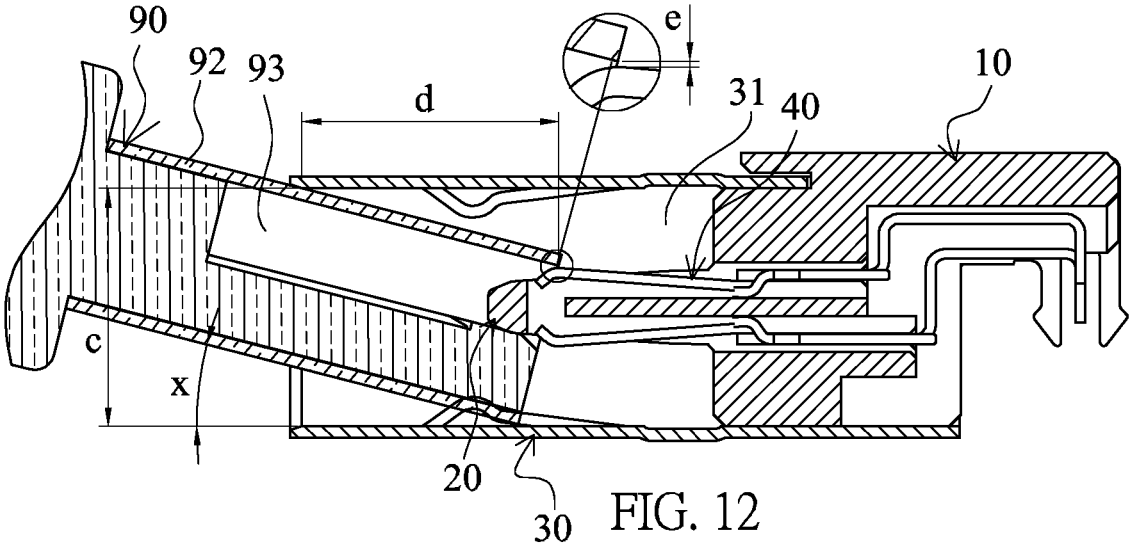
FIG. 12 is a cross-sectional side view showing the usage state of a fourth embodiment of the invention.

As shown in FIG. 12, the fourth embodiment of the invention is almost the same as the first embodiment except that the thickness of the front end of the tongue of this embodiment is increased and thus equal to about 1.3 mm, and the height "c" of the connection slot is also increased and equal to about 6.15 mm. When the USB 2.0 male plug 90 is inserted into the connection slot 31 and reaches the horizontal position of the first connection point 44 of the first terminal 40 with the maximum inclined angle between the USB 2.0 male plug 90 and the connection slot 31, the included angle "x" between the USB 2.0 male plug 90 and the connection slot 31 is equal to about 14.5 degrees, and the gap "e" between the metal housing 92 and the first connection point 44 on the top surface of the tongue is greater than 0.05 mm. The electrical connector still can be used without causing the short circuit.

Figure 13:
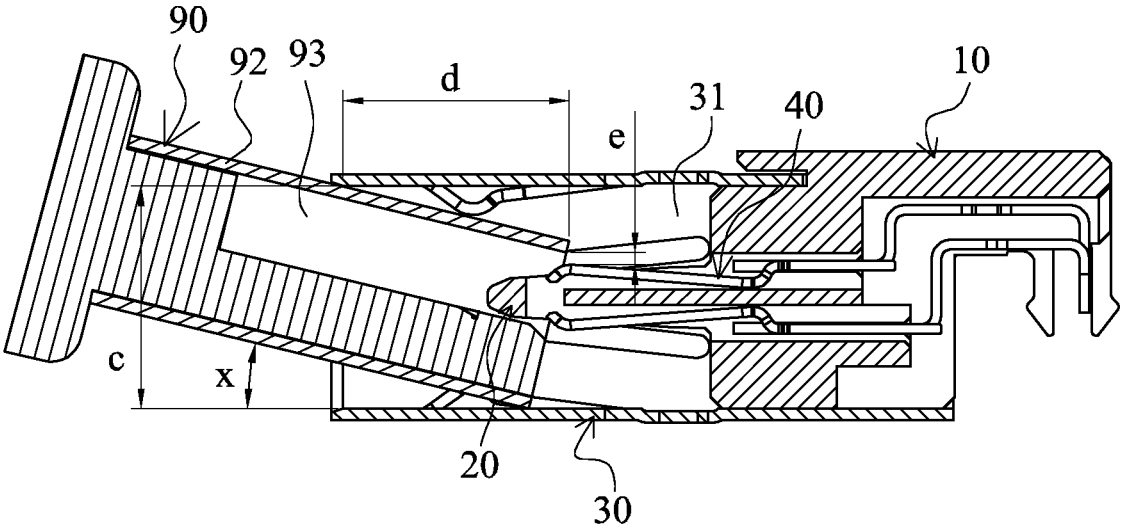
FIG. 13 is a cross-sectional side view showing the usage state of a fifth embodiment of the invention.

As shown in FIG. 13, the fifth embodiment of the invention is almost the same as the first embodiment except that the length of the metal casing 30 of this embodiment is shortened by 1 mm, and the first connection point 44 shrinks back 0.3 mm. So, the horizontal distance "d" from the insert end of the positioning plane of the connection slot 31 to the first connection point 44 of the first terminal 40 is equal to 5.9 mm. When the USB 2.0 male plug 90 is inserted into the connection slot 31 and reaches the horizontal position of the first connection point 44 of the first terminal 40 with the maximum inclined angle between the USB 2.0 male plug 90 and the connection slot 31, the included angle "x" between the USB 2.0 male plug 90 and the connection slot 31 is equal to about 13.5 degrees, and the gap "e" between the metal housing 92 and the first connection point 44 on the top surface of the tongue is greater than 0.27 mm.

Figure 14:
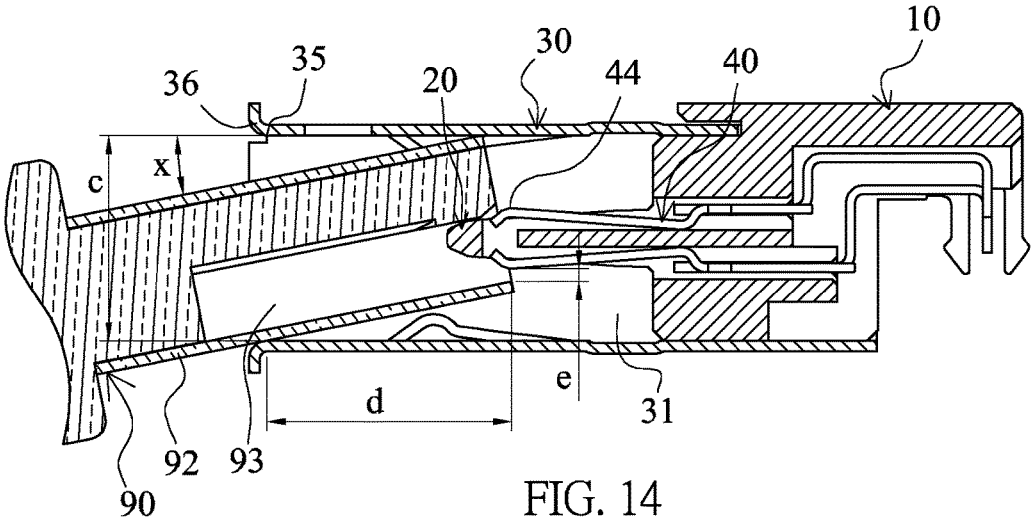
FIG. 14 is a cross-sectional side view showing the usage state of a sixth embodiment of the invention.

As shown in FIG. 14, the sixth embodiment of the invention is almost the same as the first embodiment except that the length of the metal casing 30 of this embodiment is lengthened by 0.5 mm and the front end of the metal casing 30 is bent outwards to form a guide-in inclined surface 36. So, the horizontal distance "d" from the insert end of the positioning plane of the connection slot 31 to the first connection point 44 of the first terminal 40 is equal to 7.1 mm. When the USB 2.0 male plug 90 is inserted into the connection slot 31 and reaches the horizontal position of the first connection point 44 of the first terminal 40 with the maximum inclined angle between the USB 2.0 male plug 90 and the connection slot 31, the included angle "x" between the USB 2.0 male plug 90 and the connection slot 31 is equal to about 11.2 degrees, and the gap "e" between the metal housing 92 and the first connection point 44 on the bottom surface of the tongue is greater than 0.3 mm.

Figure 15:
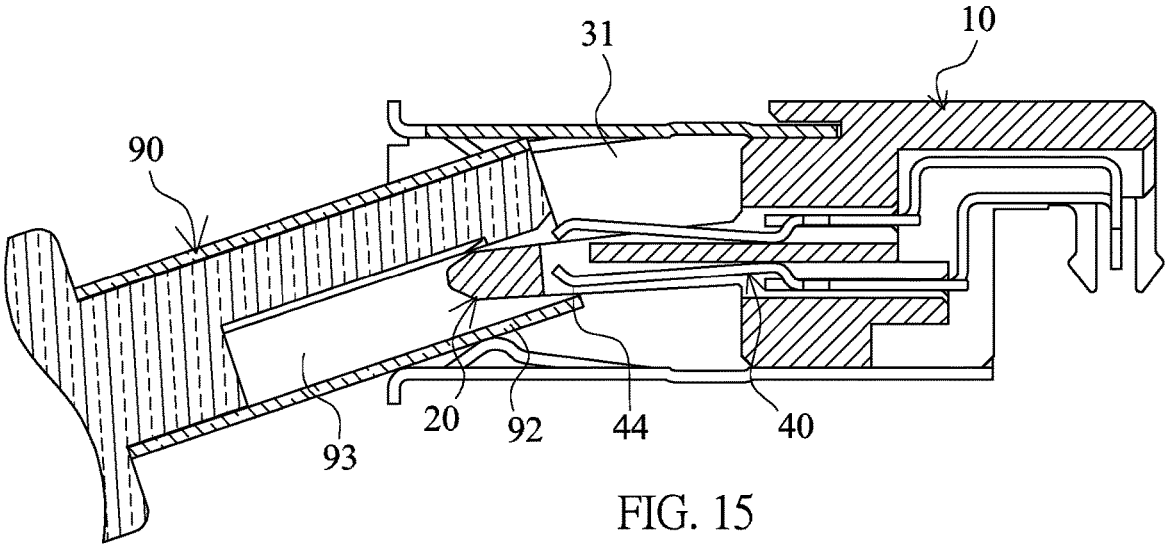
FIG. 15 is a cross-sectional side view showing the usage state of a seventh embodiment of the invention.

As shown in FIG. 15, the seventh embodiment of the invention is almost the same as the sixth embodiment except that the length of the metal casing 30 of this embodiment is shortened and the tongue 20 is lengthened. Thus, when the USB 2.0 male plug 90 is inserted into the connection slot 31 and reaches the first connection point 44 of the first terminal 40 with the too large inclined angle between the USB 2.0 male plug 90 and the connection slot 31, the distal end of the elastic arm of the first terminal 40 does not press against the tongue 20 because the tongue 20 is forced and bent. So, the first connection point 44 on the bottom surface of the tongue is kept unmoved and hidden into the tongue 20. Thus, the metal housing 92 further cannot touch the first connection point 44 on the bottom surface of the tongue.

Figure 16:
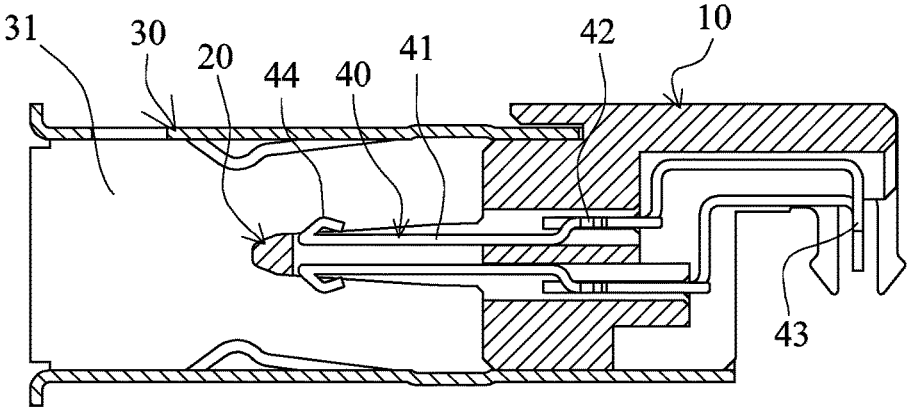
FIG. 16 is a cross-sectional side view showing the usage state of an eighth embodiment of the invention.

As shown in FIG. 16, the eighth embodiment of the invention is almost the same as the first embodiment except that the front section of the elastic arm 41 of the first terminal 40 of this embodiment is reversely bent to form the first connection point 44 projecting beyond one surface of the tongue 20. Thus, when the USB 2.0 male plug is inserted for electrical connection, the elastic arm 41 of the first terminal 40 is elastically moved forwardly in a smoother manner.

Figures 17, 18:
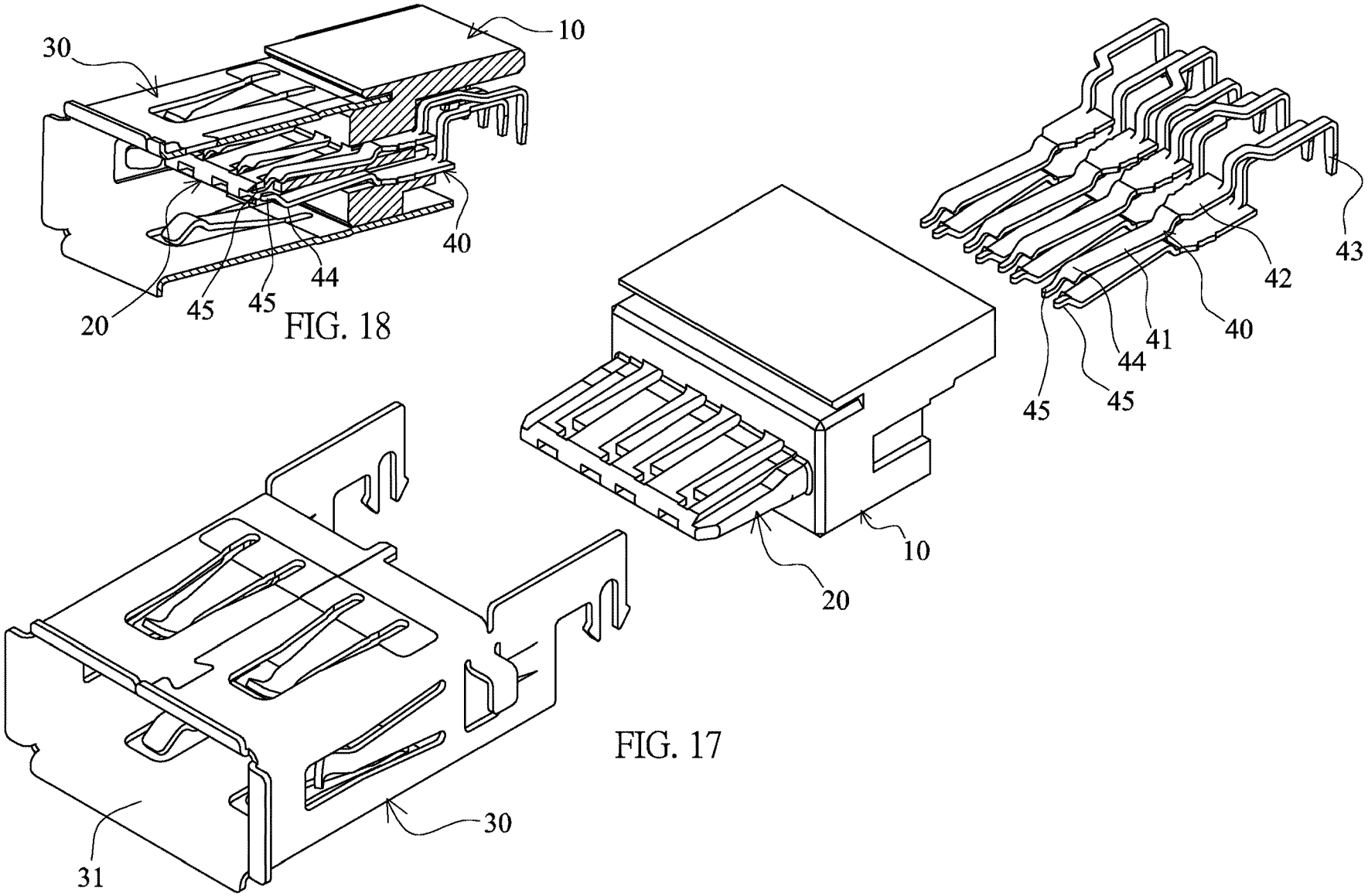
FIG. 17 is a pictorially exploded view showing a ninth embodiment of the invention.
FIG. 18 is a pictorially assembled view showing the ninth embodiment of the invention.

As shown in FIGS. 17 and 18, the ninth embodiment of the invention is almost the same as the first embodiment except that the front of the first connection point 44 of the elastic arm 41 of the first terminal 40 of this embodiment is formed with a guiding inclined surface 45 with the narrower plate surface. The guiding inclined surfaces 45 of the elastic arms 41 of the two rows of first terminals 40 are staggered in a left-to-right direction and have pre-loads pressing against the tongue 20. With this design, the first terminal 40 has the better elasticity, and the guiding inclined surfaces 45 of the two rows of first terminals 40 are staggered in the left-to-right direction to have the lager elastic moving space. However, the drawback is that the first connection point 44 of the first terminal 40 is still synchronously moved when the insertion inclined angle of the USB 2.0 male plug is too large to force and bend the tongue. Thus, the metal housing 92 may easily touch the first connection point 44 on one surface of the tongue.

Figure 20:
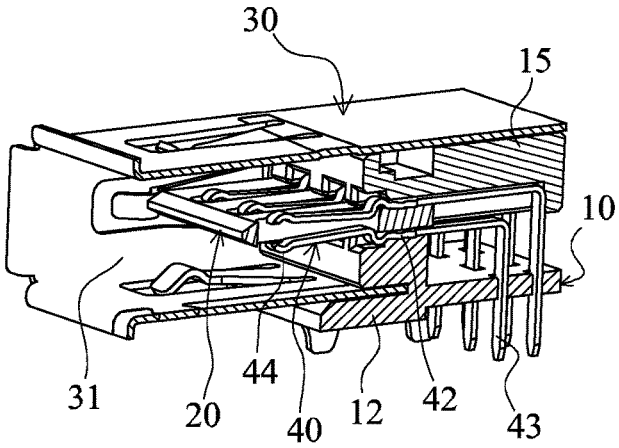
FIG. 20 is a pictorially assembled view showing the tenth embodiment of the invention.
Figure 19:
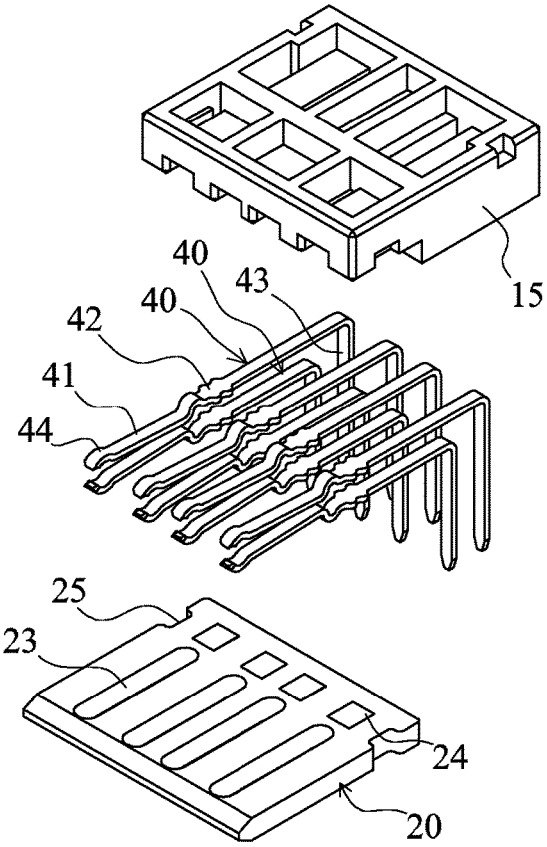
FIG. 19 is a pictorially exploded view showing a tenth embodiment of the invention.
Figure 19:
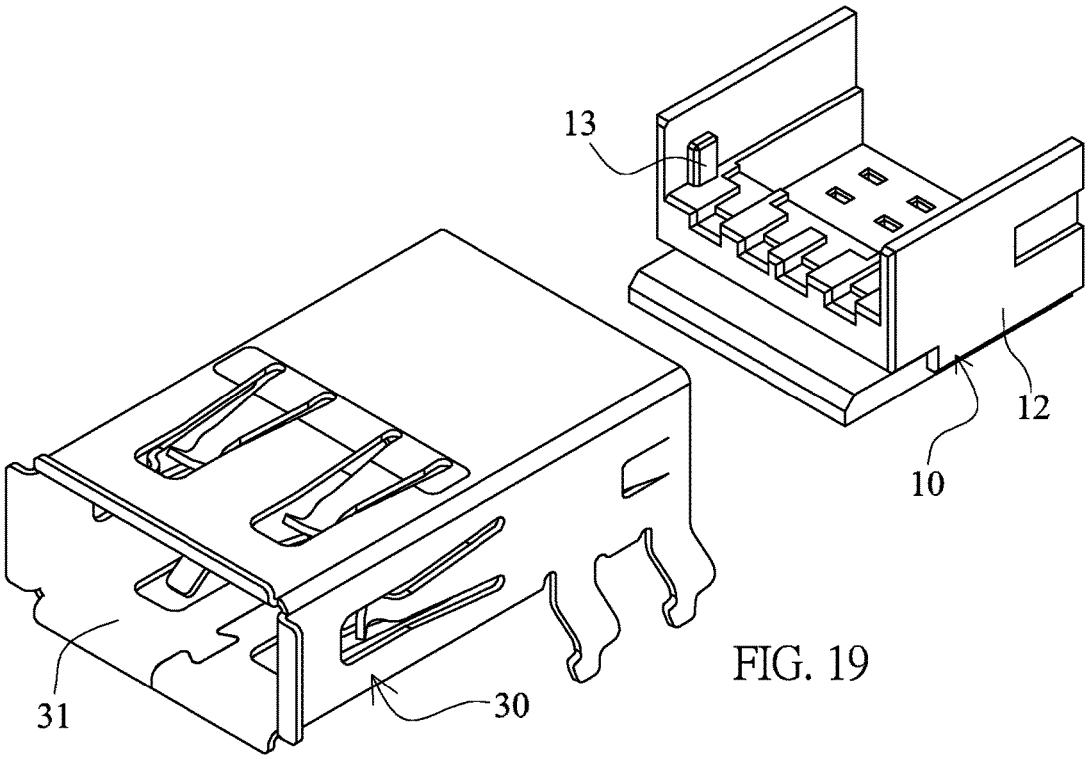

As shown in FIGS. 19 and 20, the tenth embodiment of the invention is almost the same as the first embodiment except that the tongue 20 of this embodiment is an insulating flat plate, such as a glass fiber plate, having the good structural strength. Four lengthwise through holes 23 extending in the same direction as that of the elastic arm 41 of the first terminal 40 are disposed on the tongue. Each of the two surfaces of the tongue is formed with a bonding pad 24 in back of each through hole 23. Two sides of the rear section of the tongue are formed with two notches 25, respectively. The plastic base 10 has an upper seat 15 and a lower seat 12. Two engaging blocks 13 are formed on two inner sides of the lower seat 12, respectively.

During assembling, the fixing portions 42 of the two rows of first terminals 40 are bonded to the bonding pads 24, the notches 25 of the tongue 20 are engaged with the engaging blocks 13 of the lower seat 12, and then the upper seat 15 covers the lower seat 12. Finally, the metal casing 30 is fit with and fixed to the front end of the plastic base 10.

Figure 22:
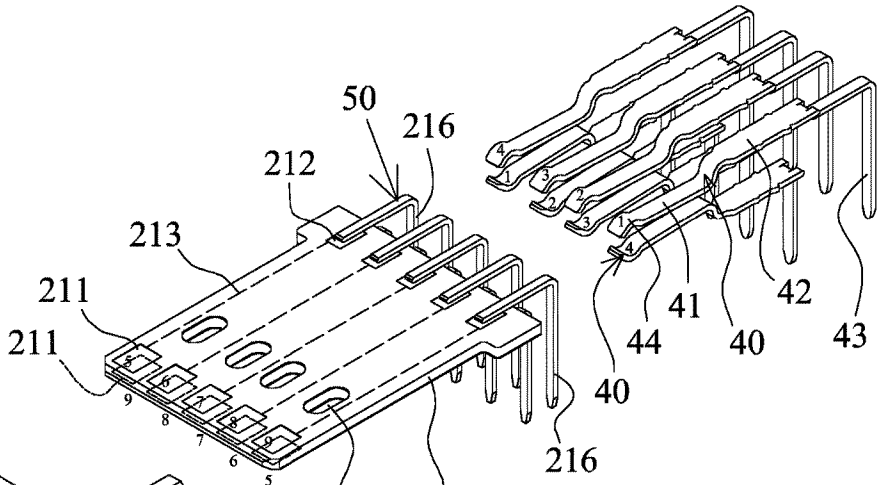
FIG. 22 is a cross-sectional side view showing the eleventh embodiment of the invention.
Figure 23:
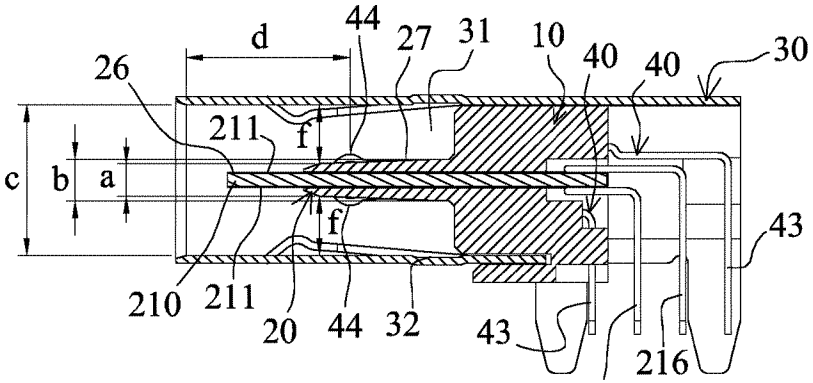
FIG. 23 is a pictorially assembled view showing a circuit board and a plastic base according to the eleventh embodiment of the invention.
Figure 23:
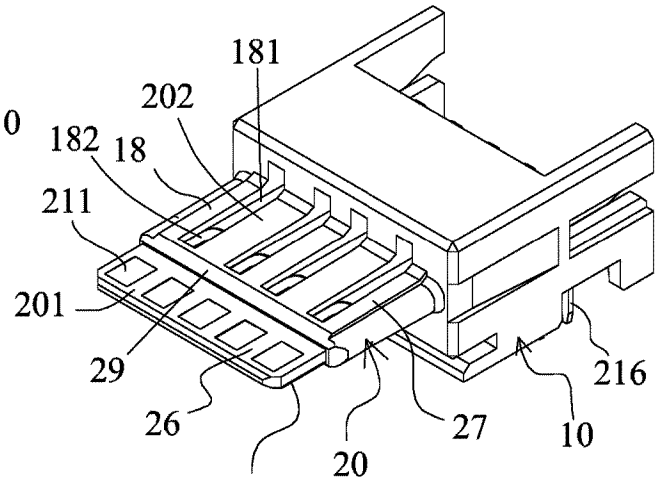
Figure 21:
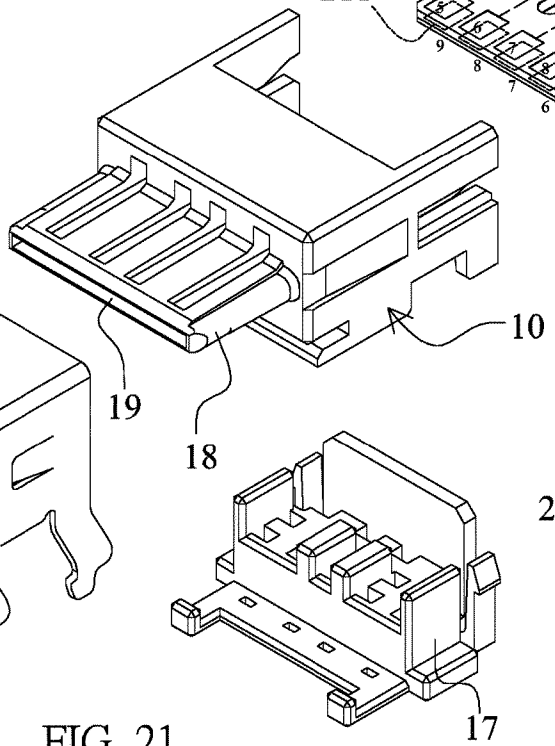
FIG. 21 is a pictorially exploded view showing an eleventh embodiment of the invention.
Figure 21:
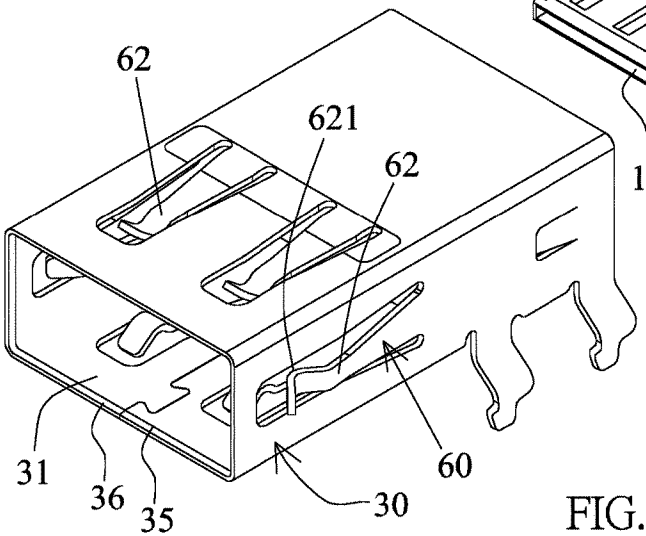

As shown in FIGS. 21 to 23, the eleventh embodiment of the invention is a USB 3.0 socket, which may be electrically connected to a USB 3.0 male plug and includes a plastic base 10, a tongue 20, a metal casing 30, two rows of second terminals 50 and two rows of first terminals 40.

The base seat in the claims is the plastic seat 10 in this embodiment.

The front end of the plastic base 10 is integrally formed with a frontwardly projecting tab 18, a transversal fitting slot 19 is provided in the plastic seat 10 and the tab 18, and a lower cover 17 covers the bottom of the plastic base 10.

As shown in FIG. 23, the rear section of the tongue 20 is the tab 18 integrally formed with the plastic base, and the front section of the tongue 20 is a circuit board 210. The tab 18 is thicker than the circuit board 210. So, the front section of the tongue 20 is a thinner flat plate body 201, top and bottom surfaces of the thinner flat plate body are two thinner and lower (depressed) low surfaces (front-section surfaces) 26, the rear section of the tongue is a thicker flat plate body 202, top and bottom surfaces of the thicker flat plate body are two thicker and higher (projecting) high surfaces (rear-section surfaces) 27, and a step 29 is formed between the low surface 26 and the high surface 27, so that the cross-sectional side view of the tongue 20 forms a convex shape. Each of the front sections of the two surfaces of the circuit board 210 is separately arranged with five second connection points 211, each of the rear sections of the two surfaces is separately arranged with five bonding points 212. Each second connection point 211 is connected to one bonding point 212 via a trace 213. Each bonding point 212 is bonded to a pin 216. In addition, four through holes 214 are formed on the circuit board. The circuit board 210 is assembled and fixed into the plastic base 10 from the rear side. The front section of the circuit board 210 passes through the fitting slot 19 of the tab 18 and projects beyond the front end of the tab 18 to form the front section of the tongue 20.

The front and rear sections of the top and bottom surfaces of the tongue 18 are flat surfaces, and the connection portion in the claims is the tongue 18 in this embodiment.

The top and bottom surfaces of the thicker flat plate body 202 of the rear section of the tongue 20 are depressed and provided with one row of concave portions 181 or through holes 182.

The two rows of second terminals 50 are respectively arranged on the top and bottom surfaces of the circuit board 210. Each second terminal is provided with the second connection point 211, the circuit 213 and the pin 216. The second connection points 211 of the two rows of second terminals 50 are respectively arranged and exposed and in flat surface contact with and fixed to the low surfaces 26 of the top and bottom surfaces of the tongue. The second connection points 211 are not lower than the highest surfaces of the front sections of the top and bottom surfaces of the tongue. The two rows of second connection points 211 are two rows of low-surface connection points (front-section-surface electrical connection point). The two rows of second terminals 50 are two rows of low-surface terminals. So, the front sections and the rear sections of the top and bottom surfaces of the tongue are different connection structures.

A connection slot 31 is formed inside the metal casing 30. The metal casing 30 is disposed at the front end of the plastic base 10 and covers the tongue 20 therein. The inner section of the connection slot 31 is formed with the concave surface 32. The front end of the insert end 35 of the positioning plane of the connection slot 31 is formed with a guide-in inclined surface 36.

In addition, the invention is provided with a locking structure 60. The locking structure 60 is provided on top and bottom sides or left and right sides of the connection slot 31. The locking structure 60 can lock a locking portion of the docking electrical connector to prevent the docking electrical connector from escaping in a direction opposite to a docking direction. The locking structure 60 includes multiple resilient snaps 62 integrally connected to the metal shell 30, and the resilient snap 62 is provided with a snap 621 projecting toward the connection slot 31.

Each row of first terminals 40 has four terminals. The first terminal 40 has an elastic arm 41, a fixing portion 42 and a pin 43. The fixing portion 42 is positioned within the plastic base 10. The elastic arm 41 extends toward the connection slot 31 and is formed with a projecting first connection point 44 projecting beyond the convex surface 27 of the tongue 20. That is, the two rows of first connection points 44 project beyond the highest surfaces of the rear sections of the top and bottom surfaces.

The two rows of first connection points 44 are two rows of upper-surface connection points (rear-section-surface electrical connection point), and the two rows of first terminals 40 are two rows of upper-surface terminals.

With the above-mentioned structure, upper and lower connection surfaces and connection points may be disposed on the front and rear sections of the two surfaces of the two surfaces of the tongue with a step formed therebetween, thereby providing the better bidirectional electrical connection. In addition, the two surfaces of the rear section of the tongue are in the forms of upper surfaces, and two surfaces of the front section of the tongue are in the forms of lower surfaces, so that the tongue structure has the better strength.

There are two rows of four first terminals 40. According to the USB Association specification, the four first terminals respectively transmit the ground (GND, circuit code 4) signal, the low differential signal (D−, circuit code 2), the low differential signal (D+, circuit code 3) and the power (VBUS, circuit code 1) signal. D− and D+ are one pair of signal terminals. The two rows of first connection points 44 have the same contact interface and are vertically aligned. The electrical connection points with the same circuit are arranged reversely, so that the electrical connector can be dual-positionally and bidirectionally electrically connected to a docking electrical connector.

There are two rows of five second terminals 50. According to the USB Association specification, the five first terminals respectively transmit RX+ (circuit code 6), RX− (circuit code 5), ground (GND, circuit code 7), TX+ (circuit code 9) and TX− (circuit code 8). RX+, RX− and TX+, TX− are two pairs of high differential signals. The two rows of second connection points 211 have the same contact interface and are vertically aligned. The electrical connection points with the same circuit are arranged reversely, so that the electrical connector can be dual-positionally and bidirectionally electrically connected to a docking electrical connector. The two rows of second connection points 211 have one pair of electrical connection points with the same circuit (GND, circuit code of 7) are vertically aligned.

The one row of second connection points 211 and one row of first connection points 44 arranged at front and rear positions form the USB 3.0 contact interface specified by the USB Association.

This embodiment is characterized in that the spaces of the connection slot 31 on the two surfaces of the tongue 20 allow the USB 3.0 male plug to be bidirectionally inserted and positioned. In addition, when the USB 3.0 male plug is inserted into the connection slot 31 and reaches a horizontal position of the first connection point 44 of the first terminal 40 with a maximum inclined angle between the USB 3.0 male plug and the connection slot 31, a gap between the metal housing of the USB 3.0 male plug and the first connection point is greater than 0.05 mm to prevent the short circuit.

To satisfy the requirements on the bidirectionally electrical connection and the elimination of the short circuit, this embodiment adopts the following designs. The thickness of the circuit board of the front section of the tongue is equal to about 0.6 mm; the thickness "a" of the front end of the tab 18 of the rear section of the tongue is equal to about 1.0 mm; the thickness "b" of the rear end of the tab is equal to about 1.6 mm; the height "c" of the connection slot is equal to about 5.8 mm; the horizontal distance "d" from the insert end 35 of the positioning plane of the connection slot 31 to the first connection point 44 of the first terminal 40 is equal to about 6.6 mm; and the space height "f" beside the two surfaces of the rear section of the tongue is equal to about 2.3 mm to 2.4 mm. That is, the parameter "f" of the front end of the rear section of the tongue is equal to (5.8 mm-1 mm)/2=2.4 mm, and is gradually decreased toward the rear end of the tongue. Because the parameter "f" beside the two surfaces of the rear section of the tongue is still greater than 2.3 mm, the concave surface 32 is provided.

Figure 24:
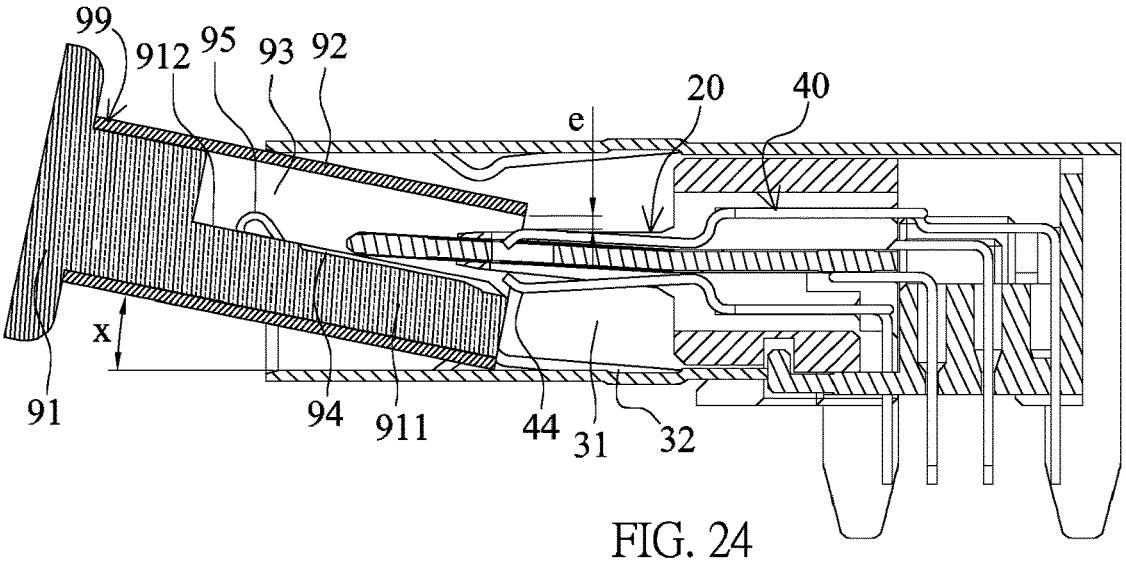
FIG. 24 is a cross-sectional side view showing the usage state of the eleventh embodiment of the invention.
Figure 25:
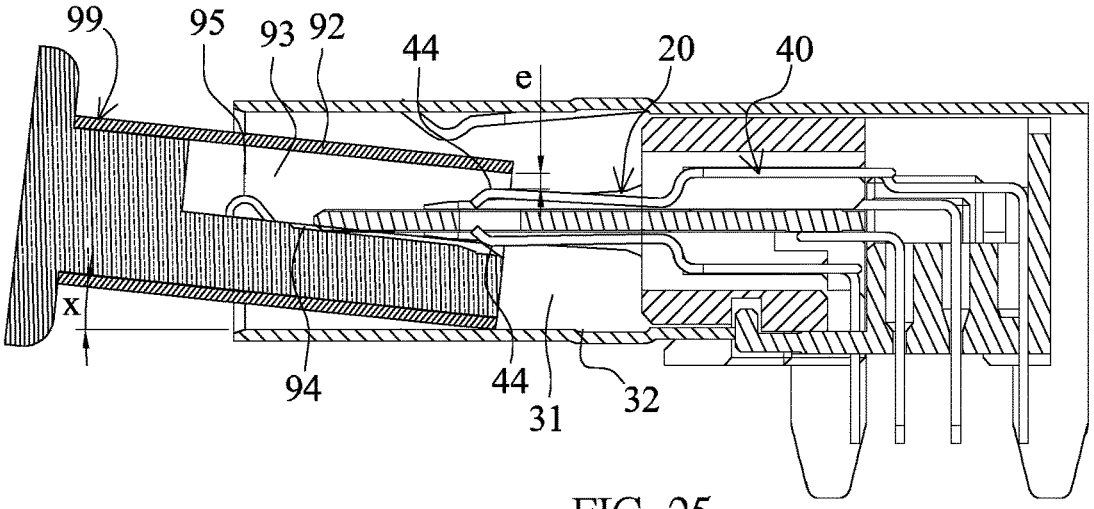
FIG. 25 is a cross-sectional side view showing the usage state of the eleventh embodiment of the invention.
Figure 26:
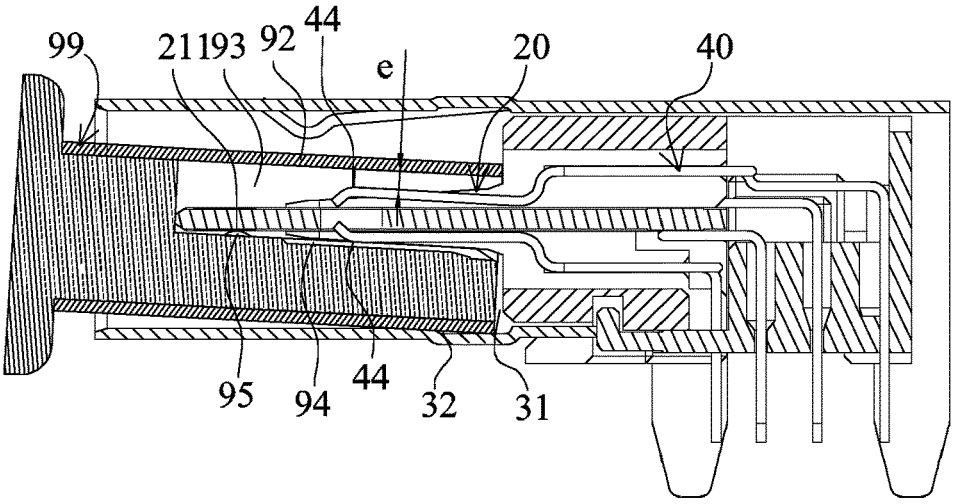
FIG. 26 is a cross-sectional side view showing the usage state of the eleventh embodiment of the invention.

The following operation description illustrates that the metal housing 92 of the USB 3.0 plug cannot touch the first connection point 44 of the first terminal 40 when the USB 3.0 plug is slantingly inserted into the connection slot at any inclined angle. As shown in FIG. 24, the dimensions and specifications of the USB 3.0 plug 99 are almost the same as those of the USB 2.0 plug 90 except that the USB 3.0 plug 99 additionally includes one row of five elastically movable connection points 95, which can be elastically moved. The USB 3.0 plug 99 is provided with an insulation seat 91 and a metal housing 92 covering the insulation seat 91. A fitting space 93 is formed in the metal housing 92. The fitting space 93 is provided with a top surface and a bottom surface. The insulation seat 91 is integrally provided with at least one connection plate 911 having a connection surface 912 forming one of the top surface and the bottom surface of the fitting space 93. The connection surface 912 is provided with a front section and a rear section having different connection structures. The rear section of the connection surface is provided with one row of elastically movable connection points 95, which are elastically movable up and down. When the connection point 94 of the USB 3.0 male plug 99 faces upwards and the USB 3.0 male plug 99 is inserted into the connection slot 31 and reaches the first connection point 44 of the first terminal 40 with the maximum inclined angle between the USB 3.0 male plug 99 and the connection slot 31, the included angle "x" between the USB 3.0 male plug 99 and the connection slot 31 is about 11.5 degrees, the tongue 20 is accommodated within the connection space 93 of the USB 3.0 male plug 99, and the gap "e" between the metal housing 92 and the first connection point 44 on the top surface of the tongue is still greater than 0.3 mm to prevent the short circuit from occurring. As shown in FIG. 25, when the USB 3.0 male plug 99 is further inserted inwards and then gradually rotated to be horizontal, the gap "e" is greater than 0.38 mm, and the included angle "x" between the USB 3.0 male plug 99 and the connection slot 31 is equal to about 6.5 degrees. As shown in FIG. 26, when the USB 3.0 male plug 99 is further inserted inwards to a predetermined position, the connection point 94 of the USB 3.0 male plug 99 touches the first connection point 44 of the first terminal on the bottom surface of the rear section of the tongue, and the elastically movable connection point 95 touches the second connection point 211 on the bottom surface of the front section of the tongue. At this time, the gap "e" is greater than 0.48 mm, and the half height (2.25 mm) of the USB 3.0 male plug 99 can be tightly fit and positioned with the space height "f" (2.3 mm to 2.4 mm) below the tongue 20. Although the rear end of the tongue 20 is thicker to decrease the space height "f", the rear section of the connection slot 31 is formed with the concave surface 32 to provide the compensation. Thus, the USB 3.0 male plug 99 still can be inserted into the innermost end for positioning.

Similarly, when the connection point 94 of the USB 3.0 male plug 99 faces upwards and the USB 3.0 male plug 99 is inserted for positioning, the state is also the same as that mentioned hereinabove. Thus, detailed descriptions thereof will be omitted.

According to the above-mentioned description, it is obtained that, when the USB 3.0 male plug 99 is inserted into the connection slot 31 for positioning, the essential conditions that the metal housing 92 of the USB 3.0 male plug 99 does not touch the first connection point 44 reside in the thickness of the front end of the rear section of the tongue 20 and the height of the first connection point 44 projecting beyond the rear section of the tongue 20. Because the height "k" of the connection space of the USB 3.0 male plug 99 is equal to 1.95 mm and the first connection point 44 must have an elastically movable height of about 0.3 mm, the thickness of the front end of the rear section of the tongue 20 cannot be greater than 1.55 mm in order to ensure that the metal housing 92 cannot touch the first connection point 44.

However, the user may not insert the plug exactly horizontally. If the insertion angle is too great, then the metal housing 92 of the USB 3.0 male plug 99 touches the first connection point 44 during the insertion process. The design factors affecting the maximum slanting insertion angle of the USB 3.0 male plug 99 reside in the height "c" of the connection slot and the horizontal distance "d" from the insert end 35 of the positioning plane of the connection slot 31 to the first connection point 44 of the first terminal 40. That is, the maximum inclined angle of inserting the USB 3.0 male plug 99 becomes smaller and the gap "e" becomes greater as the height "c" of the connection slot gets smaller and the horizontal distance "d" gets greater.

Figure 27:
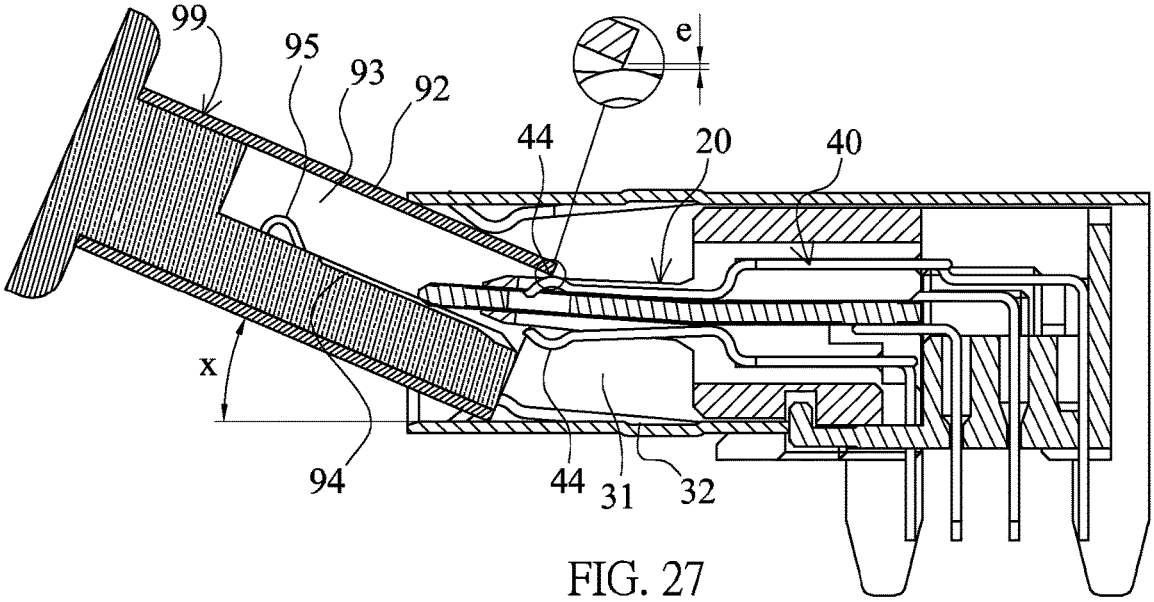
FIG. 27 is a cross-sectional side view showing a usage state of a twelfth embodiment of the invention.

As shown in FIG. 27, the twelfth embodiment of the invention is almost the same as the eleventh embodiment except that the horizontal distance from the insert end of the positioning plane of the connection slot 31 to the first connection point 44 of the first terminal 40 of this embodiment is shorter and equal to about 3.6 mm. When the USB 3.0 male plug 99 is inserted into the connection slot 31 and reaches the horizontal position of the first connection point 44 of the first terminal 40 with the maximum inclined angle between the USB 3.0 male plug 99 and the connection slot 31, the included angle "x" between the USB 3.0 male plug 99 and the connection slot 31 is equal to about 24 degrees, and the gap "e" between the metal housing 92 and the first connection point 44 on the top surface of the tongue is greater than 0.05 mm. The electrical connector still can be used without causing the short circuit.

Figure 28:
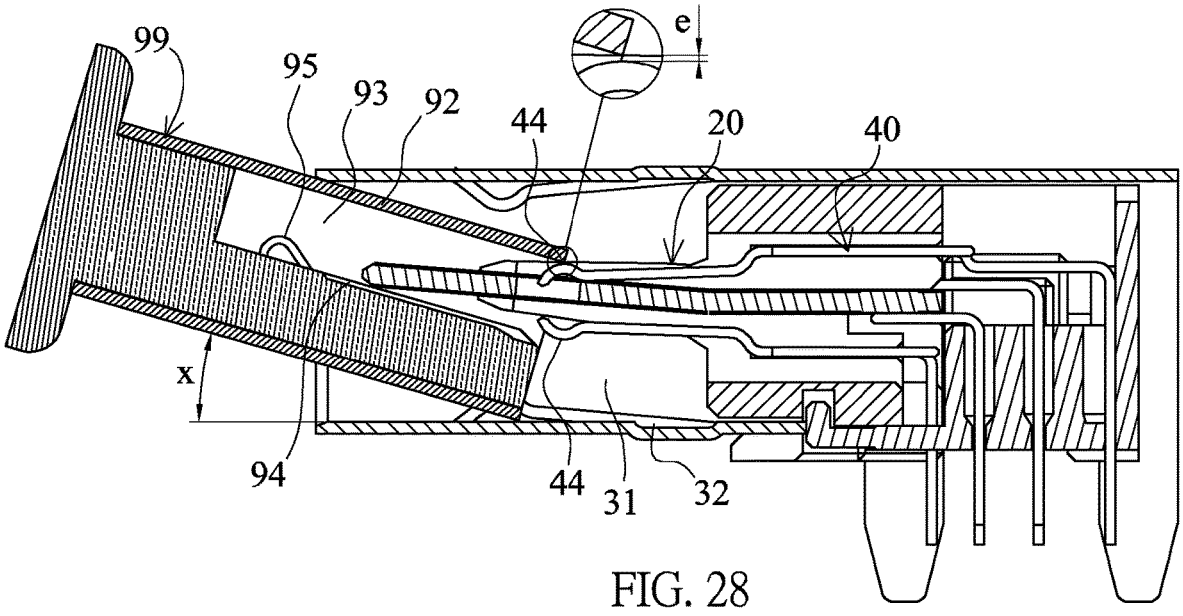
FIG. 28 is a cross-sectional side view showing a usage state of a thirteenth embodiment of the invention.

As shown in FIG. 28, the thirteenth embodiment of the invention is almost the same as the eleventh embodiment except that the thickness of the front end of the rear section of the tongue of this embodiment is increased and equal to about 1.3 mm, and the height "c" of the connection slot is also increased and equal to about 6.2 mm. When the USB 3.0 male plug 99 is inserted into the connection slot 31 and reaches the horizontal position of the first connection point 44 of the first terminal 40 with the maximum inclined angle between the USB 3.0 male plug 99 and the connection slot 31, the included angle "x" between the USB 3.0 male plug 99 and the connection slot 31 is equal to about 16 degrees, and the gap "e" between the metal housing 92 and the first connection point 44 on the top surface of the tongue is still greater than 0.05 mm. The electrical connector still can be used without causing the short circuit.

Figures 29, 30:
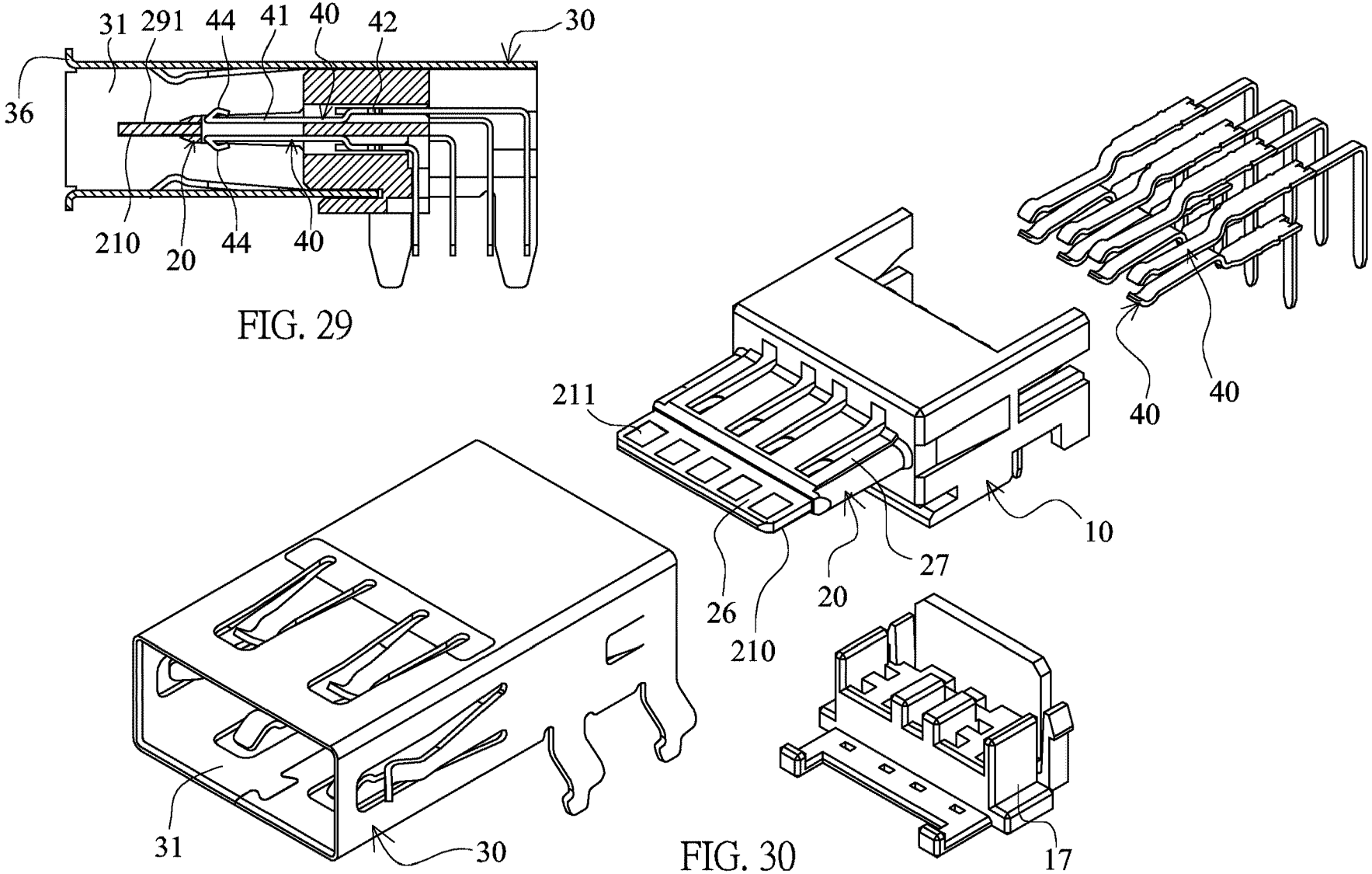
FIG. 29 is a cross-sectional side view showing a fourteenth embodiment of the invention.
FIG. 30 is a pictorially exploded view showing a fifteenth embodiment of the invention.

As shown in FIG. 29, the fourteenth embodiment of the invention is almost the same as the eleventh embodiment except that the front section of the elastic arm 41 of the first terminal 40 of this embodiment is reversely bent to form the first connection point 44 projecting beyond one surface of the tongue 20. Thus, when the USB 3.0 male plug is inserted for electrical connection, the elastic arm 41 of the first terminal 40 is elastically moved forwardly in a smoother manner.

As shown in FIG. 30, the fifteenth embodiment of the invention is almost the same as the eleventh embodiment except that the plastic base 10 of this embodiment is embedded with the circuit board 210 and then injection molded to position the circuit board 210.

Figure 31:
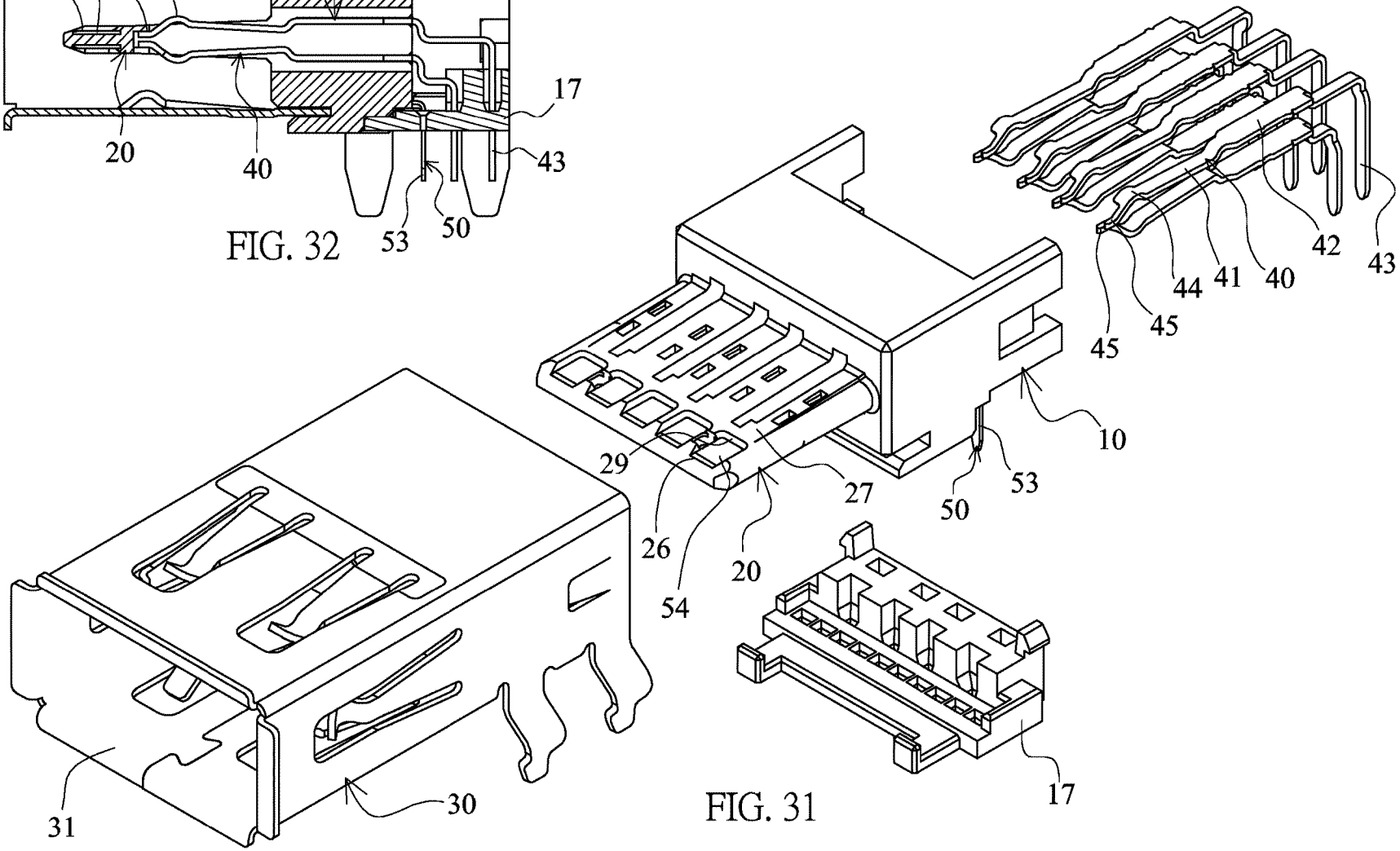
FIG. 31 is a pictorially exploded view showing a sixteenth embodiment of the invention.
Figure 32:
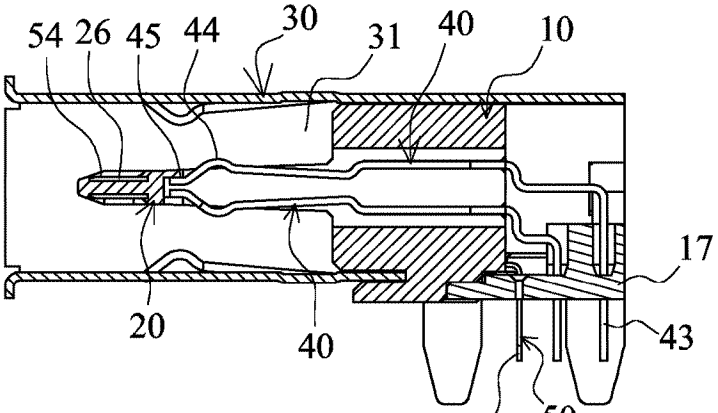
FIG. 32 is a cross-sectional side view showing the sixteenth embodiment of the invention.

As shown in FIGS. 31 and 32, the sixteenth embodiment of the invention is almost the same as the eleventh embodiment except that the front of the first connection point 44 of the elastic arm 41 of the first terminal 40 of this embodiment is formed with a guiding inclined surface 45 with the narrower plate surface. The guiding inclined surfaces 45 of the elastic arms 41 of the two rows of first terminals 40 are staggered in a left-to-right direction and have pre-loads pressing against the tongue 20. With this design, the first terminal 40 has the better elasticity, and the guiding inclined surfaces 45 of the two rows of first terminals 40 are staggered in the left-to-right direction to have the lager elastic moving space. However, the drawback is that the first connection point 44 of the first terminal 40 is still synchronously moved when the insertion inclined angle of the USB 3.0 male plug is too large to force and bend the tongue. Thus, the metal housing 92 may easily touch the first connection point 44 on one surface of the tongue.

The two rows of first connection points 44 are two rows of upper-surface connection points, and the two rows of first terminals 40 are two rows of upper-surface terminals.

In addition, two rows of second terminals 50 and the tongue 20 are embedded into the plastic base 10 of this embodiment and are positioned when the plastic base 10 is injection molded. The second terminal 50 has a second connection point 54, which cannot be elastically moved, and a pin 53 extending out of the plastic base 10. The tapered tongue 20 and the plastic base 10 are integrally formed. That is, the tongue 20 has the thinner front end and the thicker rear end. The front section of the tongue 20 is formed with the thinner and lower concave surface 26, and the rear section thereof is formed with the thicker and higher convex surface 27. A step 29 is formed between the concave surface 26 of the front section of the two surfaces of the tongue and the convex surface 27 of the rear section, so that the cross-sectional side view of the tongue 20 forms a convex shape. The second connection points of the two rows of second terminals 50 are respectively arranged on the concave surfaces 26 of the front sections of the two surfaces of the tongue. The first connection points 44 of the two rows of first terminals 40 are respectively projectingly arranged on the convex surfaces 27 of the rear sections of the two surfaces of the tongue. The tongue 20 may also be referred to as a connection portion since it is an insulative portion providing the connection function.

The two rows of second connection points 54 are two rows of lower-surface connection points, and the two rows of second terminals 50 are two rows of lower-surface terminals.

With the above-mentioned structure, upper and lower connection surfaces and connection points may be disposed on the front and rear sections of the two surfaces of the two surfaces of the tongue with a step formed therebetween, thereby providing the better bidirectional electrical connection. In addition, the two surfaces of the rear section of the tongue are in the forms of upper surfaces, and two surfaces of the front section of the tongue are in the forms of lower surfaces, so that the tongue structure has the better strength.

Figure 33:
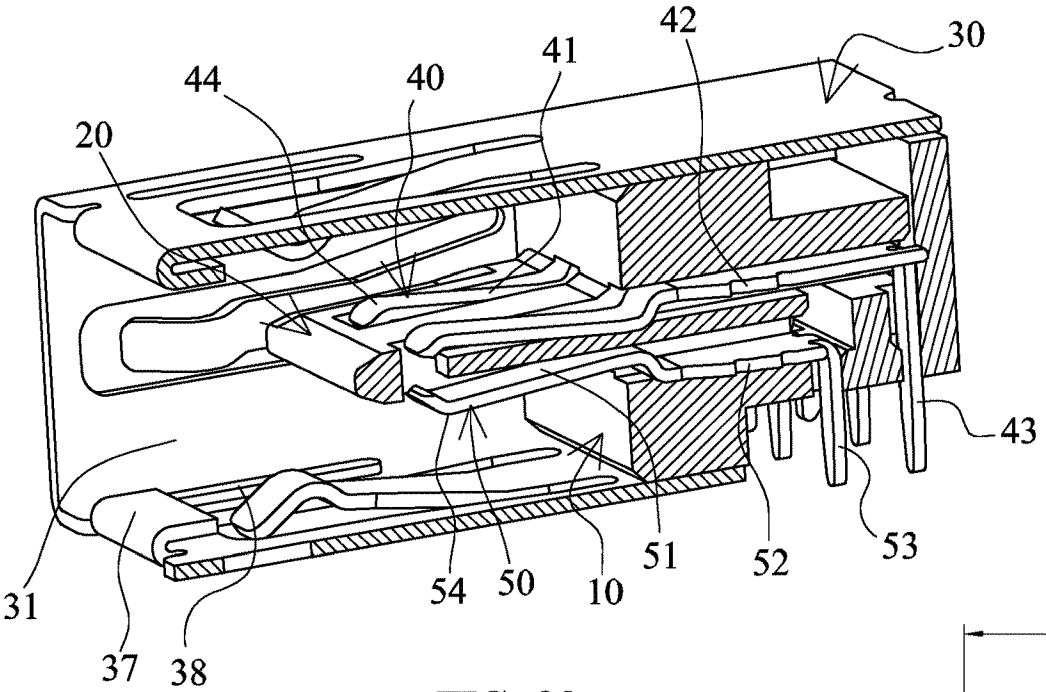
FIG. 33 is a pictorially cross-sectional view showing a seventeenth embodiment of the invention.
Figure 34:
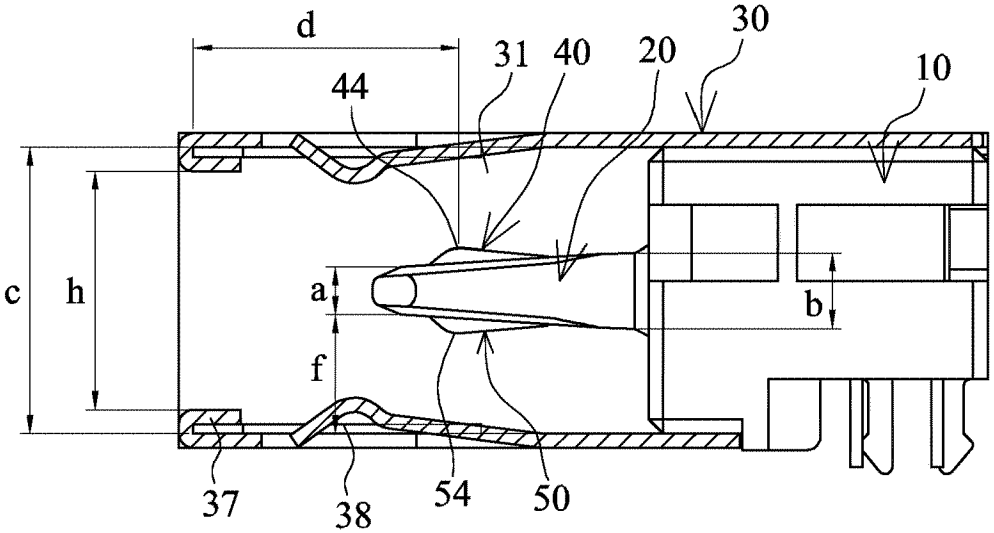
FIG. 34 is a cross-sectional side view showing the seventeenth embodiment of the invention.

As shown in FIGS. 33 and 34, the seventeenth embodiment of the invention is a USB 2.0 socket, which includes a plastic base 10, a tongue 20, a metal casing 30 and two rows of first terminals 40.

The tongue 20 integrally projects beyond the front end of the plastic base 10, and has a thinner front end and a thicker rear end so that it is tapered from rear to front. Thus, the tongue is stronger and cannot be easily broken.

The metal casing 30 is formed with a connection slot 31. The metal casing 30 is disposed at the front end of the plastic base 10 and covers the tongue 20 therein. The top surface and the bottom surface of the insert port of the connection slot 31 are formed with projections 37 projecting toward a center of the connection slot. The vertical distance between the projections 37 on the top and bottom surfaces is the height h of the insert port. So, the height h of the insert port is smaller than the height "c" of the connection slot inside the insert port, so that the gap can be decreased when the male plug is inserted for connection to prevent the wobble. The projection 37 is formed by reversely bending the front end of the metal casing 30 toward the inside of the connection slot 31. In addition, the top surface and the bottom surface of the front section of the connection slot 31 are formed with two projections 38 extending from front to rear.

Each row of first terminals 40 has four terminals. The first terminal 40 has an elastic arm 41, a fixing portion 42 and a pin 43. The fixing portion 42 is positioned within the plastic base 10. The elastic arm 41 extends toward the connection slot 31 and is formed with a projecting first connection point 44 projecting beyond one surface of the tongue 20. The first connection points 44 of the two rows of first terminals 40 respectively project beyond the two surfaces of the tongue 20.

The designed dimensions are listed in the following. The thickness "a" of the front end of the tongue is about 1 mm, the thickness "b" of the rear end of the tongue is about 1.6 mm, the height "c" of the connection slot is about 6 mm and the height of the projection 37 is 0.5 mm. So, the height h of the insert port of the connection slot is 5.0 mm, the horizontal distance "d" from the insert end 35 of the positioning plane of the connection slot 31 to the first connection point 44 of the first terminal 40 is equal to about 5.6 mm, and the heights "f" of spaces beside the two surfaces of the tongue are equal to about 2.5 mm to 2.2 mm That is, the parameter "f" at the front end of the tongue is equal to (6 mm−1 mm)/2=2.5 mm, and is gradually decreased toward the rear end of the tongue.

Figure 35:
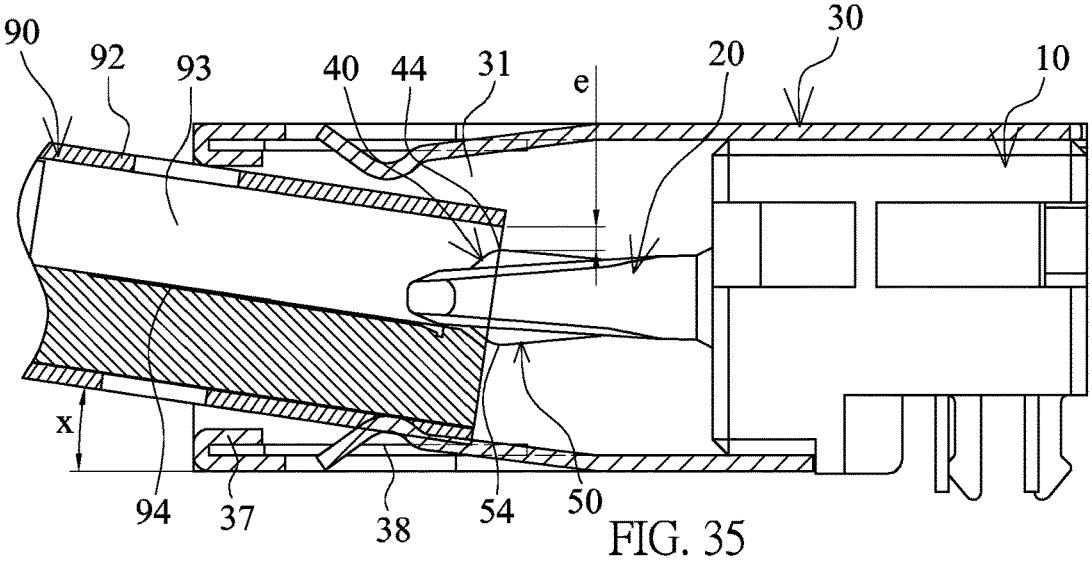
FIG. 35 is a cross-sectional side view showing a usage state of the seventeenth embodiment of the invention.
Figure 36:
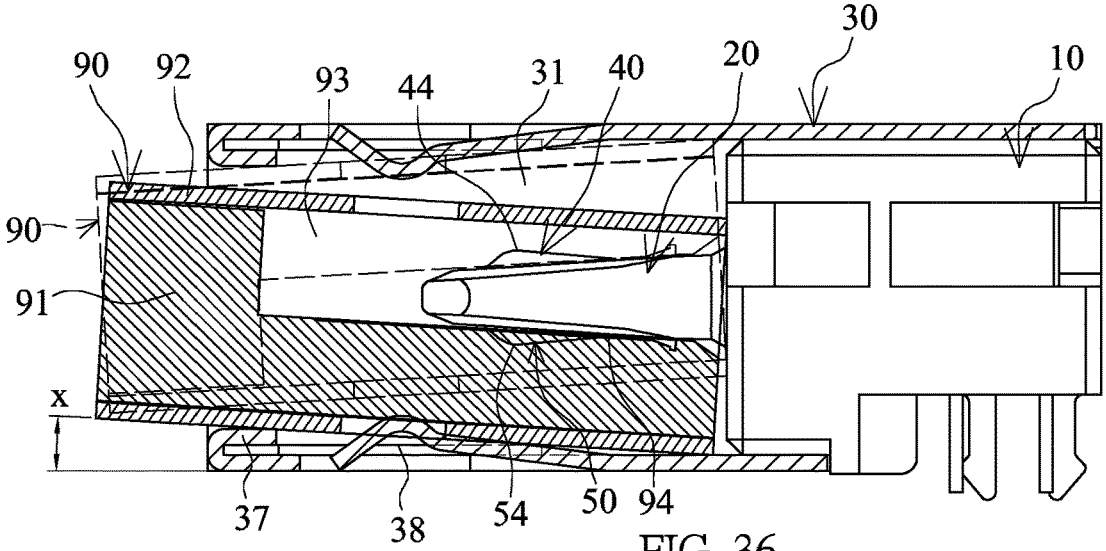
FIG. 36 is a cross-sectional side view showing the usage state of the seventeenth embodiment of the invention.

As shown in FIG. 35, the connection point 94 of the USB 2.0 male plug 90 faces upwards and the USB 2.0 male plug 90 is normally inserted into the insert port and tilts downwards (the pictorial view when the USB 2.0 male plug 90 is normally inserted and tilts downwards is illustrated in FIG. 1A). Thus, when the USB 2.0 male plug 90 is inserted into the connection slot 31 and reaches the horizontal position of the first connection point 44 of the first terminal 40 with a maximum inclined angle between the male plug 90 and the connection slot 31, the included angle "x" between the USB 2.0 male plug 90 and the connection slot 31 is about 8.8 degrees, the tongue 20 is accommodated within the connection space 93 of the USB male plug, and the gap "e" between the metal housing 92 and the first connection point 44 on the top surface of the tongue is greater than 0.48 mm to prevent the short circuit from occurring. As shown in FIG. 36, when the USB 2.0 male plug 90 is further inserted inwards and then gradually rotated to be horizontal, the gap "e" is increased because the USB 2.0 male plug 90 is gradually rotated to be horizontal so that the short circuit cannot be further caused. At this time, the included angle "x" between the USB 2.0 male plug 90 and the connection slot 31 is equal to about 3.4 degrees and the USB 2.0 male plug 90 tilts downwards and is slantingly positioned, and the half height (2.25 mm) of the USB 2.0 male plug 90 can be fit and positioned with the space height "f" (2.5 mm to 2.2 mm) below the tongue 20. Although the rear end of the tongue 20 is thicker to decrease the space height "f", the USB 2.0 male plug 90 can be fit with the connector because the USB 2.0 male plug 90 is slantingly positioned.

Figure 1B:
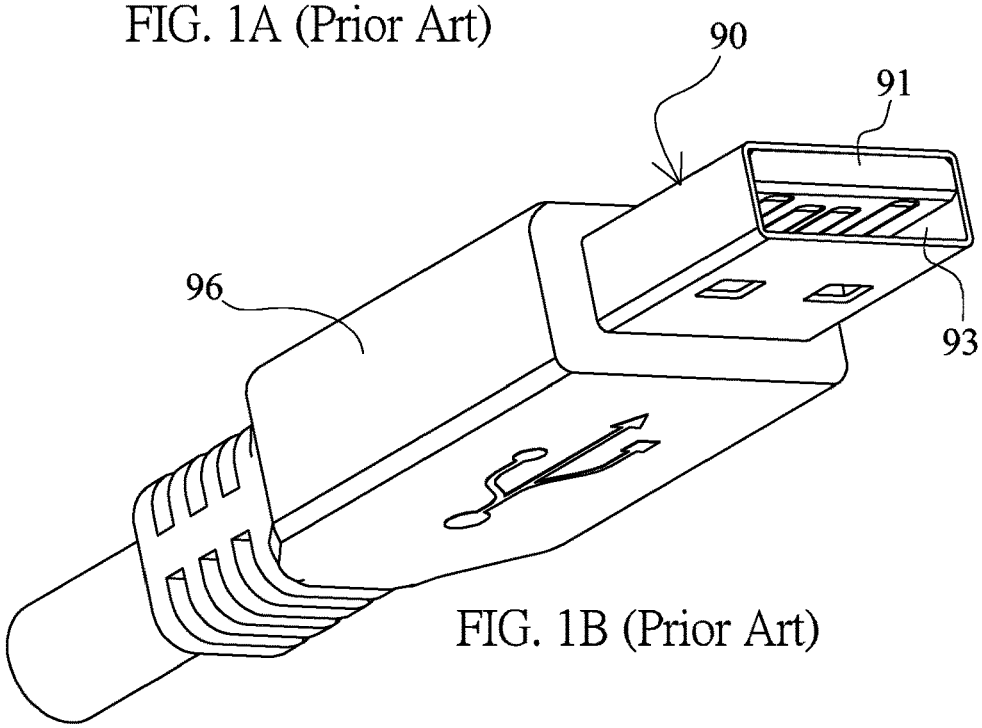
FIG. 1B (Prior Art)
FIG. 1B is a pictorial view showing the conventional USB 2.0 male plug, which is reversely inserted and tilts upwards.
Figure 2:
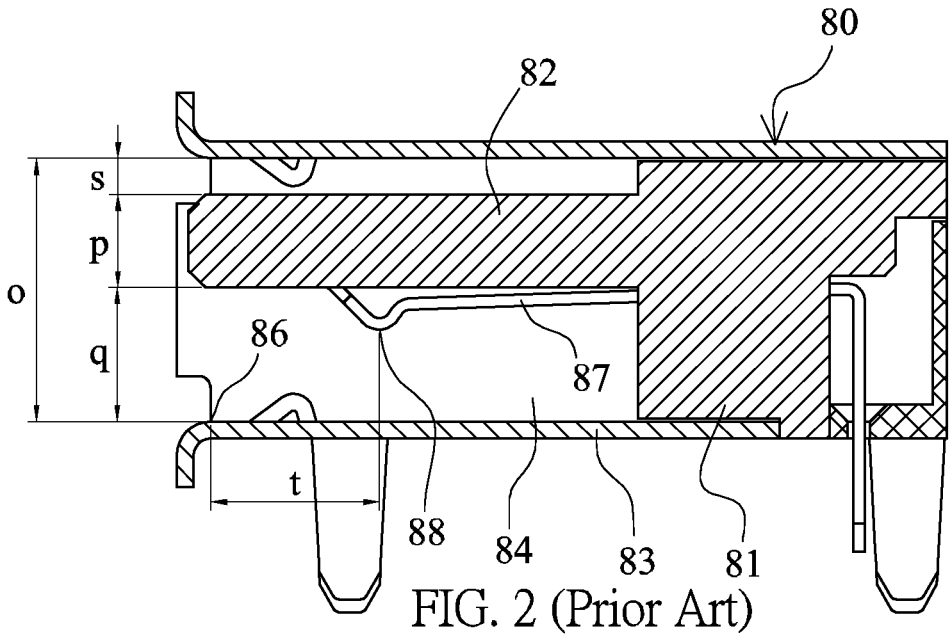
FIG. 2 (Prior Art)
FIG. 2 is a cross-sectional side view showing a conventional USB 2.0 socket.
Figure 2A:
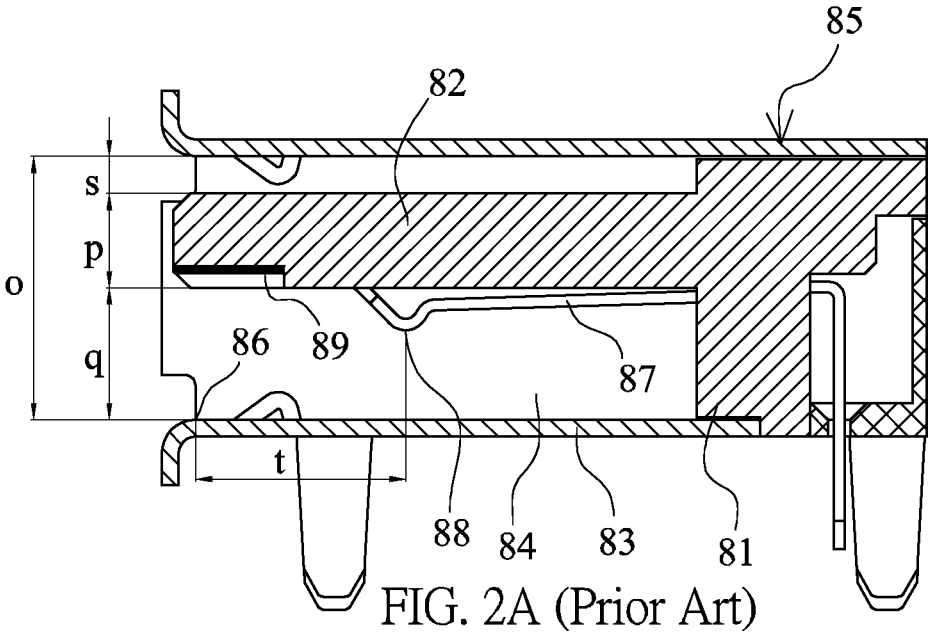
FIG. 2A (Prior Art)
FIG. 2A is a cross-sectional side view showing a conventional USB 3.0 socket.

The dashed line in FIG. 36 represents that the USB 2.0 male plug 90 is inwardly and reversely inserted from the insert port with the connection point 94 facing downwards and tilts upwards (FIG. 1B is a pictorial view showing the convention USB 2.0 male plug, which is reversely inserted and tilts upwards) and upwardly and slantingly positioned. Because the connection slot 31 can make the USB 2.0 male plug 90 be either normally inserted and tilt downwards or be reversely inserted and tilt upwards so that the bidirectionally inserted USB 2.0 male plug 90 can be slantingly positioned, and the USB 2.0 male plug 90, which is normally inserted and tilts downwards, and the USB 2.0 male plug 90, which is reversely inserted and tilts upwards, cross each other. So, the maximum overlap area exists at the position of the insert port of the connection slot, such that the height h of the insert port can be decreased.

The feature of this embodiment resides in that the top surface and the bottom surface of the insert port of the connection slot 31 are formed with projections 37 to decrease the height h of the insert port. Thus, the maximum inclined angle of inserting the USB 2.0 male plug 90 can be decreased to prevent the short circuit, decrease the insert gap and prevent the wobble. In addition, two ribs 38, extending from front to rear, are formed on the top surface and the bottom surface of the front section of the connection slot 31 so that the above-mentioned effect can be enhanced.

Furthermore, because the tongue 20 is tapered, the USB 2.0 male plug is inserted into the connection slot 31 and slantingly positioned. This embodiment adopts the projection 37 to decrease the height of the insert port. Thus, when the USB 2.0 male plug 90 is inserted for connection, the USB 2.0 male plug 90 can be connected at the insert port of the connection slot and can be stably positioned.

Figure 37:
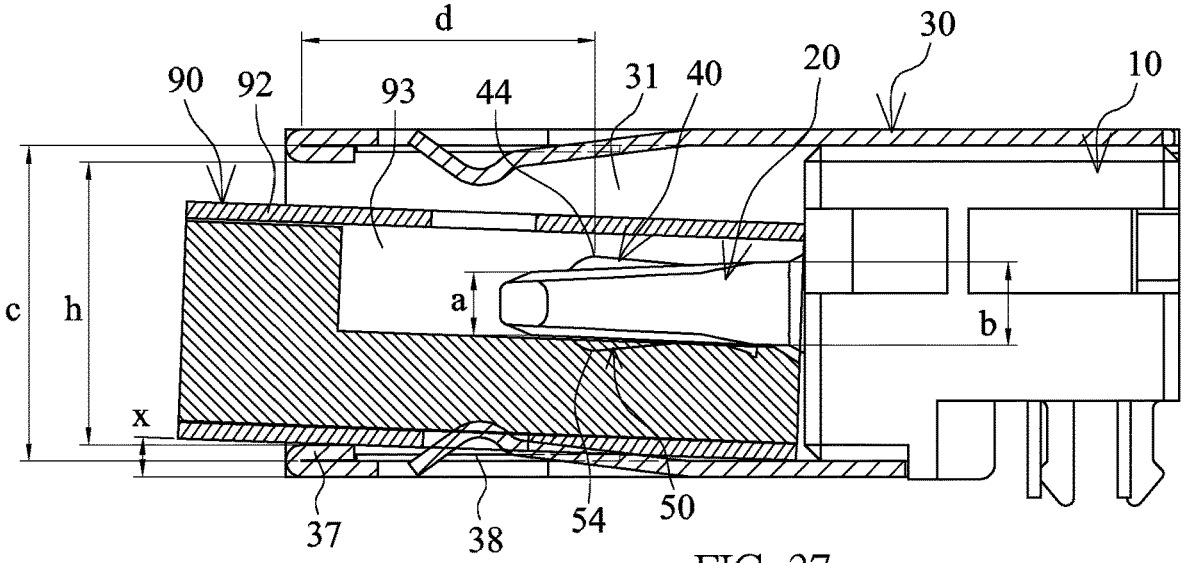
FIG. 37 is a cross-sectional side view showing an eighteenth embodiment of the invention.

As shown in FIG. 37, the eighteenth embodiment of the invention is almost the same as the seventeenth embodiment except that the thickness "a" of the front end of the tongue 20 of this embodiment is increased to 1.2 mm, the height of the projection 37 is decreased to 0.3 mm, and the height h of the insert port is increased to 5.4 mm. At this time, the positioning included angle "x" between the USB 2.0 male plug 90 and the connection slot 31 is equal to about 2.05 degrees.

Figure 38:
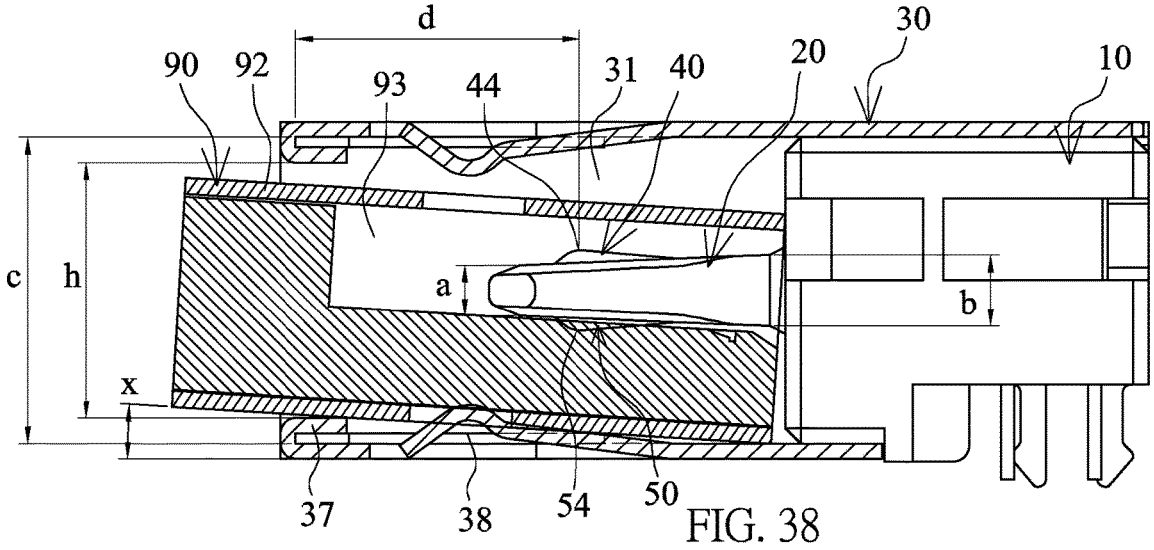
FIG. 38 is a cross-sectional side view showing a nineteenth embodiment of the invention.

As shown in FIG. 38, the nineteenth embodiment of the invention is almost the same as the seventeenth embodiment except that the thickness "b" of the rear end of the tongue 20 of this embodiment is decreased to 1.4 mm. At this time, the positioning included angle "x" between the USB 2.0 male plug 90 and the connection slot 31 is equal to about 3.5 degrees.

Figure 39:
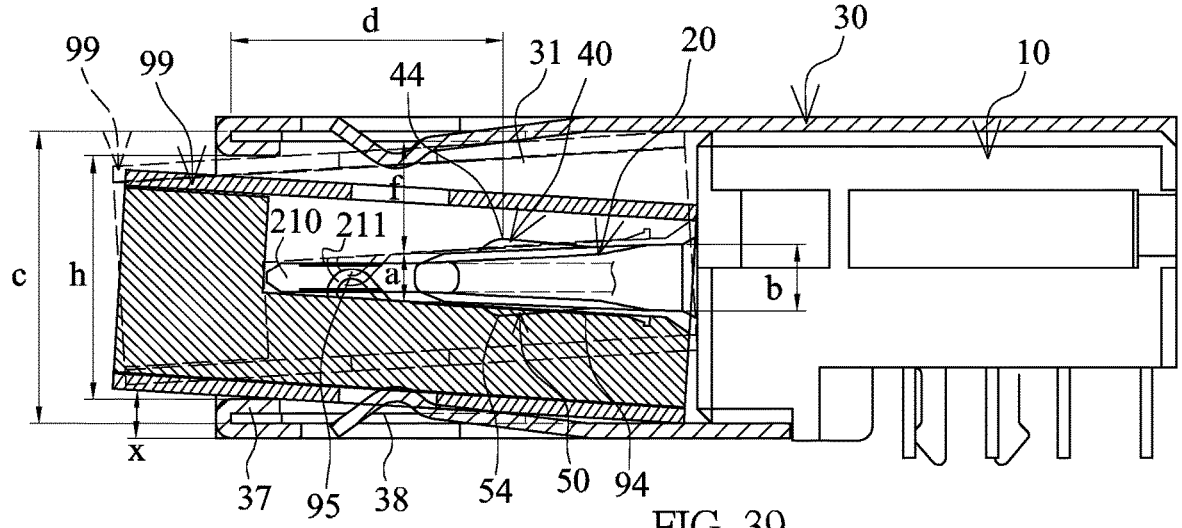
FIG. 39 is a cross-sectional side view showing a twentieth embodiment of the invention.

As shown in FIG. 39, the twentieth embodiment of the invention is a USB 3.0 socket, which is almost the same as the seventeenth embodiment and the eleventh embodiment. The design dimensions of this embodiment are listed in the following. The thickness "a" of the front end of the tongue is equal to about 1 mm; the thickness "b" of the rear end of the tongue is equal to about 1.6 mm; the height "c" of the connection slot is equal to about 6 mm; and the height of the projection 37 is equal to 0.5 mm. So, the height h of the insert port of the connection slot is equal to 5.0 mm, the horizontal distance "d" from the insert end 35 of the positioning plane of the connection slot 31 to the first connection point 44 of the first terminal 40 is equal to about 5.6 mm, and the heights "f" of the spaces beside the two surfaces of the tongue are equal to about 2.5 mm to 2.2 mm. At this time, the positioning included angle "x" between the USB 3.0 male plug 99 and the connection slot 31 is equal to about 3.5 degrees. The solid line in FIG. 39 represents that the USB 3.0 male plug 99 is normally inserted, tilts downwards and is then slantingly positioned, while the dashed line represents that the USB 3.0 male plug 99 is reversely inserted, tilts upwards and is then slantingly positioned.

Figure 40:
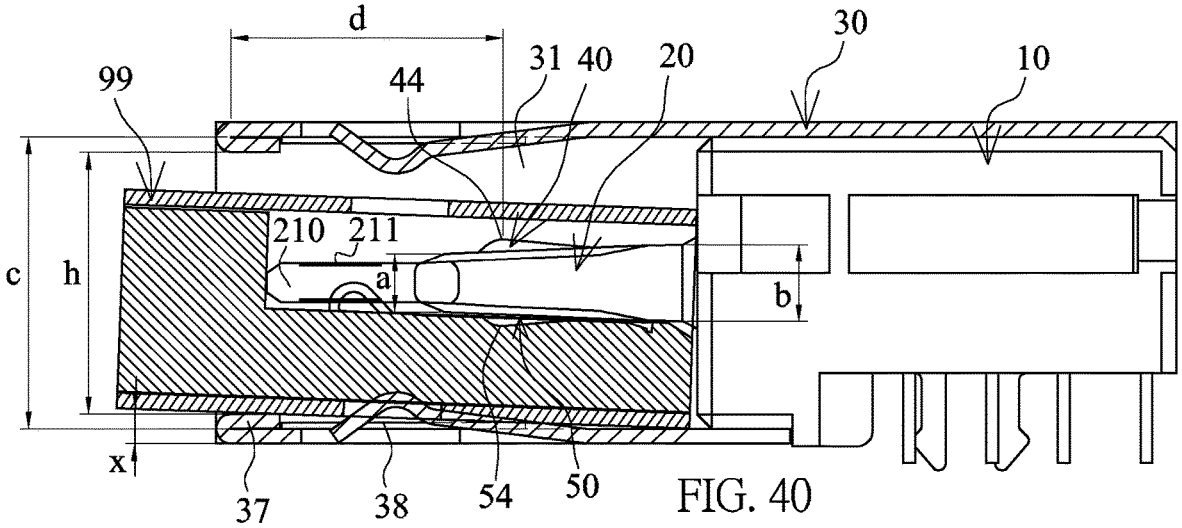
FIG. 40 is a cross-sectional side view showing a $21^{st}$ embodiment of the invention.

As shown in FIG. 40, the 21$^{st}$ embodiment of the invention is almost the same as the twentieth embodiment except that the thickness "a" of the front end of the tongue 20 of this embodiment is increased to 1.2 mm, the height of the projection 37 is equal to 0.3 mm, and the height h of the insert port is equal to 5.4 mm. At this time, the positioning included angle "x" between the USB 3.0 male plug 99 and the connection slot 31 is equal to about 2.05 degrees.

Figure 41:
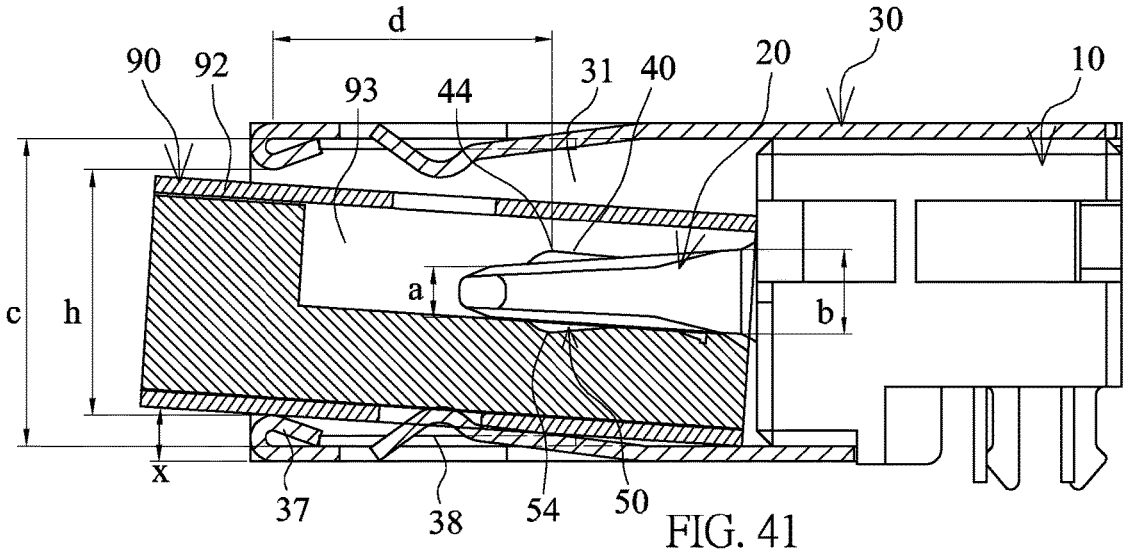
FIG. 41 is a cross-sectional side view showing a $22^{nd}$ embodiment of the invention.

As shown in FIG. 41, the 22$^{nd}$ embodiment of the invention is a USB 2.0 socket, which is almost the same as the seventeenth embodiment except that the height of the projection 37 of this embodiment is increased to 0.6 mm, and the height h of the insert port is decreased to 4.8 mm. At this time, the positioning included angle "x" between the USB 2.0 male plug 90 and the connection slot 31 is equal to about 4.3 degrees.

Figure 42:
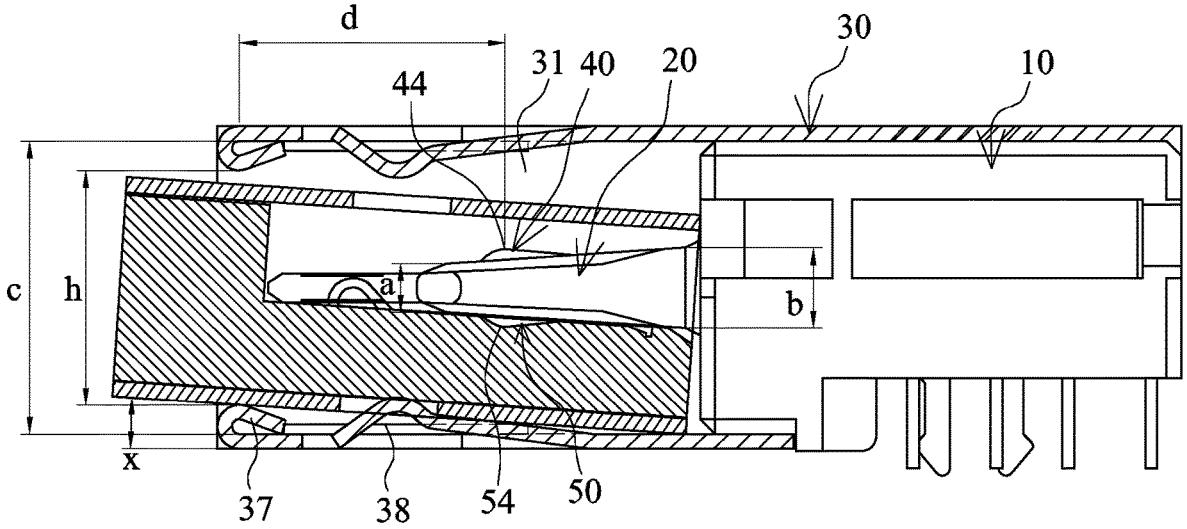
FIG. 42 is a cross-sectional side view showing a $23^{rd}$ embodiment of the invention.

As shown in FIG. 42, the 23$^{rd}$ embodiment of the invention is almost the same as the 22$^{nd}$ embodiment, wherein the associated dimensions of the two embodiments are the same except that this embodiment is a USB 3.0 socket.

Figure 43:
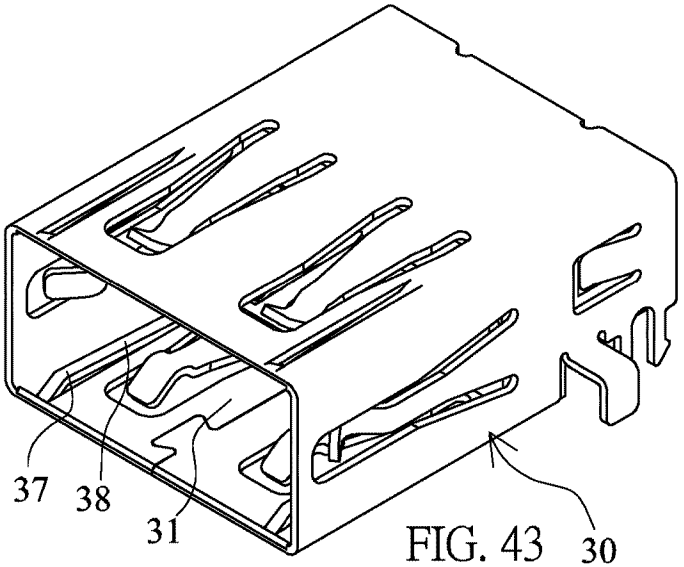
FIG. 43 is a pictorial view showing a $24^{th}$ embodiment of the invention.
Figure 44:
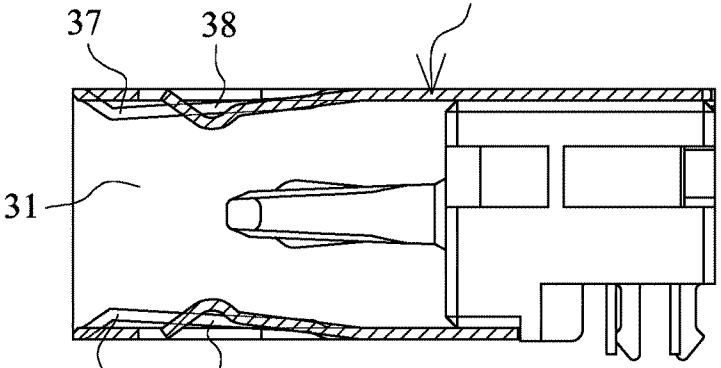
FIG. 44 is a cross-sectional side view showing the $24^{th}$ embodiment of the invention.

As shown in FIGS. 43 and 44, the 24$^{th}$ embodiment of the invention is almost the same as the seventeenth embodiment except that the top surface and the bottom surface of the front section of the connection slot 31 of this embodiment are respectively prodded to form two projecting strips. The highest point of the front end of the projecting strip is the projection 37. The projecting strip extends backwards to form the rib 38, and the projecting level of the rib 38 is gradually decreased in a backward direction.

Figure 45:
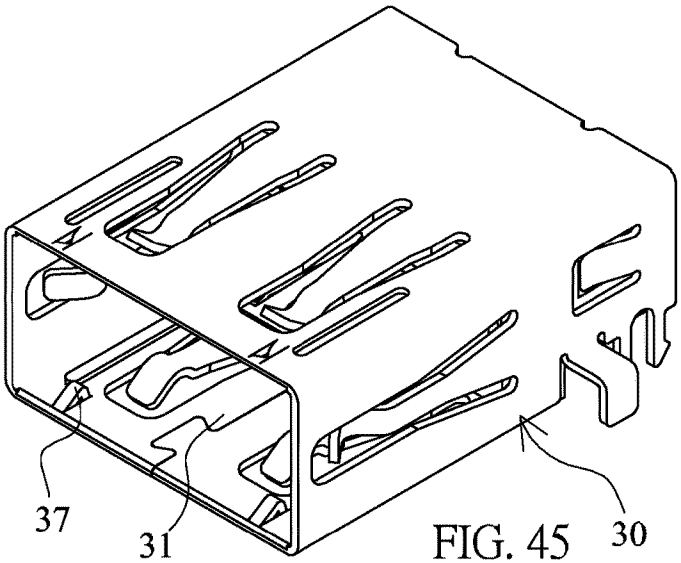
FIG. 45 is a pictorial view showing a $25^{th}$ embodiment of the invention.
Figure 46:
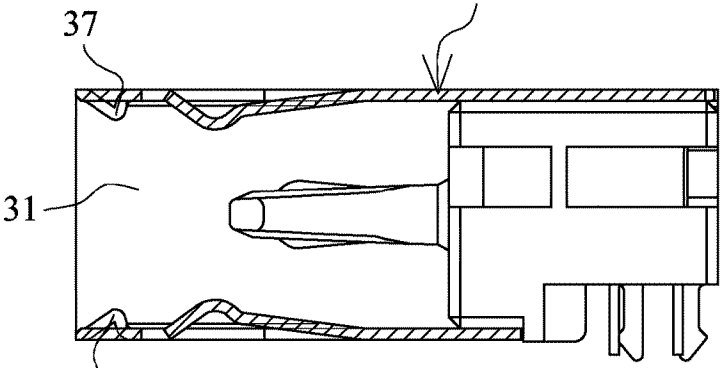
FIG. 46 is a cross-sectional side view showing the $25^{th}$ embodiment of the invention.

As shown in FIGS. 45 and 46, the $25^{th}$ embodiment of the invention is almost the same as the seventeenth embodiment except that the projections 37 of this embodiment are two projecting points prodded from the top surface and the bottom surface of the front end of the connection slot 31.

According to the structure of the invention, it is possible to ensure that the metal housing of the male plug does not touch the first connection point of the first terminal when the plug is bidirectionally inserted and connected to the socket. The wobble gap between the inserted male plug and the socket can be decreased, and the male plug can be stably positioned. In addition, the gap for isolating the male plug from the first connection point is possibly enlarged to obtain the maximum safety coefficient for the inserted male plug, and the electrical connection function is ensured to be stable and reliable.

As mentioned hereinabove, the gap between the male plug and the first connection point is enlarged so that the male plug may be inserted and removed with the maximum product safety coefficient. The enlarged gap can make the male plug, the first connection point of the first terminal, the metal housing and the tongue have the larger dimensional tolerance, so that the product abnormality caused by the dimension abnormality can be reduced, the possibility caused by the product abnormality can be reduced, and the yield can be significantly enhanced. Although many efforts have been done to increase the product safety coefficient, it is impossible to completely prevent the abnormal operation when the dimension abnormality is caused or the male plug is improperly operated to cause the male plug and the first connection point of the first terminal to have the abnormal condition. Thus, when the male plug and the first connection point of the first terminal are short circuited, a built-in safety protection circuit may be disposed on the circuit board or the plug. The safety protection circuit includes power and ground safety protection circuits, dedicated protection semiconductor chips, fuses, over-current protection elements, electrical elements with the rectifier functions, capacitors, software, delay circuit designs, other electrical elements or other operation means capable of preventing the short-circuited condition. With the safety protection circuit, the bidirectional electrical connector cannot damage the electric property even if the plug is abnormally plugged and removed so that the male plug and the first connection point of the first terminal, which are short circuited instantaneously or for a long time, can be protected by the safety protection circuit. Thus, when the male plug touches the first connection point of the first terminal, the short-circuited condition cannot occur. Even if the short-circuited condition is caused, no damage is caused.

In the bidirectional electrical connector having the short-circuit proof mechanism of the invention in conjunction with the general electronic circuit protection, the dual short-circuit proof objects can be achieved so that the product becomes safer and more reliable.

Figure 47:
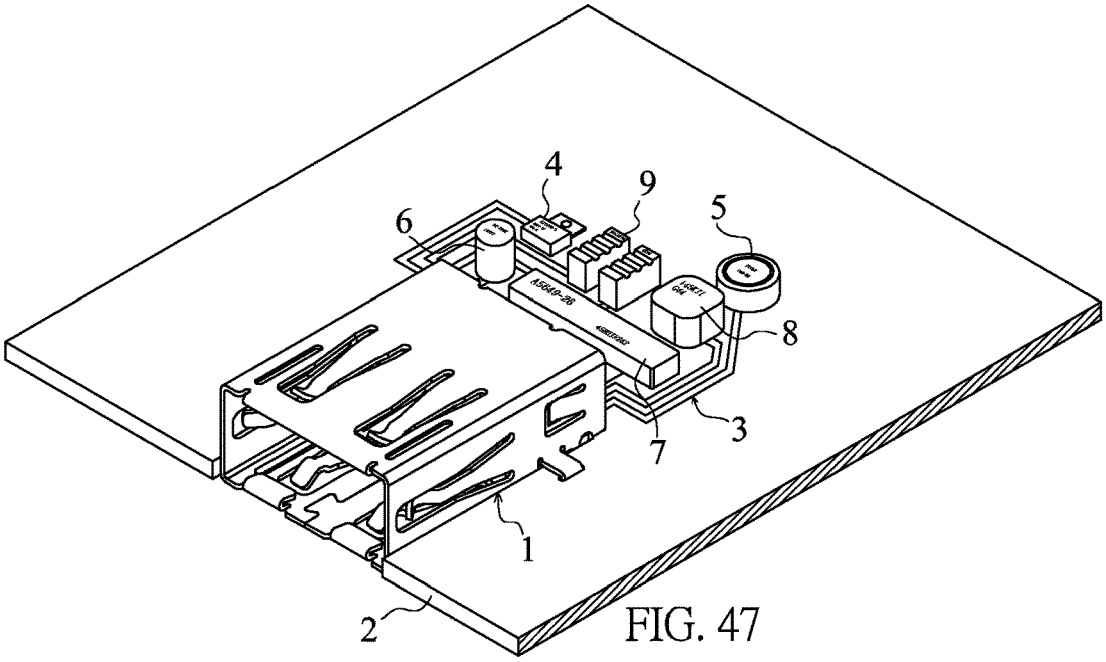
FIG. 47 is a pictorial view showing a $26^{th}$ embodiment of the invention.

As shown in FIG. 47, the $26^{th}$ embodiment of the invention includes a bidirectional electrical connector 1, a circuit board 2 and a safety protection circuit 3.

The bidirectional electrical connector 1 is almost the same as each of the above-mentioned embodiments and can be bidirectionally electrically connected to the USB 2.0 male plug. The bidirectional electrical connector 1 is bonded to the circuit board 2.

The safety protection circuit 3 includes a power and ground circuit safety protection device 4, a dedicated protection semiconductor chip 5, a fuse 6, an over-current protection element 7, an electrical element 8 with the rectifier function, and another electrical element 9, which are disposed on the circuit board 2. The safety protection circuit 3 is electrically connected to the bidirectional electrical connector 1. That is, multiple electrical connection points of the top surface of the tongue of the bidirectional electrical connector 1 and multiple electrical connection points of the bottom surface thereof are correspondingly electrically connected to the corresponding circuits of the safety protection circuit 3. Thus, the electrical connection points of the multiple electrical connection points of the top and bottom surfaces of the tongue of the bidirectional electrical connector 1 having the same circuit are electrically connected together through the safety protection circuit 3. For the further explanation, for example, the same power circuits of the top and bottom surfaces of the tongue of the bidirectional electrical connector 1 are electrically connected to the power circuit of the safety protection circuit 3. So, the same power circuits of the top and bottom surfaces of the tongue form the electrical connection. The same grounding circuits of the top and bottom surfaces of the tongue of the bidirectional electrical connector 1 are electrically connected to the grounding circuit of the safety protection circuit 3. So, the same grounding circuits of the top and bottom surfaces of the tongue are electrically connected together. Other same circuits are also electrically connected together through the circuit board in a similar manner.

With the above-mentioned structure, when the USB 2.0 male plug is inserted into or removed from the bidirectional electrical connector abnormally so that the metal housing of the USB 2.0 male plug and the first connection point of the first terminal touches each other, the safety protection device 3 prevents the short-circuited condition from occurring or prevents the electrical damage from being caused even if the short-circuited condition occurs.

Figure 48:
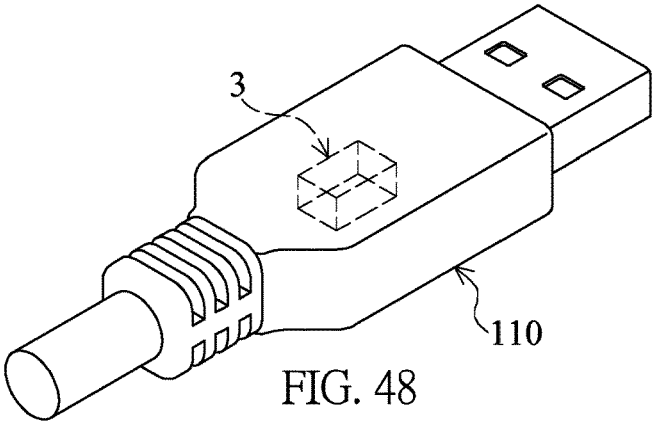
FIG. 48 is a pictorial view showing a $27^{th}$ embodiment of the invention.

As shown in FIG. 48, the $27^{th}$ embodiment of the invention is a male plug 110 with a built-in safety protection circuit 3, which may be the same as that of FIG. 47. Thus, when the USB 2.0 male plug 110 is inserted into or removed from the bidirectional electrical connector abnormally so that the metal housing of the USB 2.0 male plug 110 and the first connection point of the first terminal touches each other, the safety protection device 3 prevents the short-circuited condition from occurring or prevents the electrical damage from being caused even if the short-circuited condition occurs.

Figure 49:
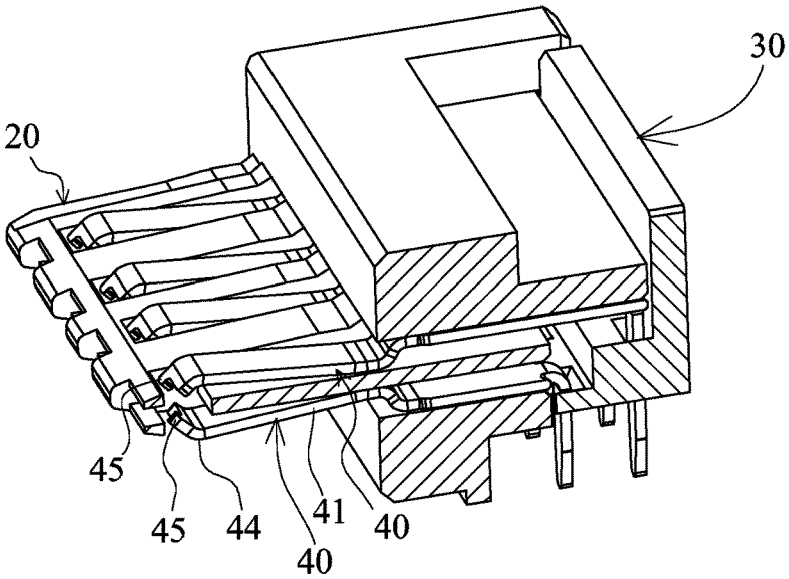
FIG. 49 is a pictorial view showing a $28^{th}$ embodiment of the invention.

As shown in FIG. 49, the $28^{th}$ embodiment of the invention is almost the same as the ninth embodiment, wherein a front end of the first connection point 44 of the elastic arm 41 of the first terminal 40 of this embodiment is formed with a guiding inclined surface 45 having a narrower plate surface, the first connection points 44 of the two rows of first terminals correspond to each other in a vertical direction, and the guiding inclined surfaces 45 of the elastic arms 41 of the two rows of first terminals 40 are staggered in a left to right direction and suspended without touching the tongue 20. In addition, the metal casing of this embodiment may be similar to that of the seventeenth embodiment.

While the invention has been described by way of examples and in terms of preferred embodiments, it is to be understood that the invention is not limited thereto. To the contrary, it is intended to cover various modifications. Therefore, the scope of the appended claims should be accorded the broadest interpretation so as to encompass all such modifications.

What is claimed is:

1. A bidirectional duplex electrical connector, comprising:

a circuit board provided with two sets of circuits, wherein the circuit board is provided with one or multiple rows of bonding points, and the one or multiple rows of bonding points are electrically connected to the two sets of circuits;

a base seat; and a connection portion disposed on a front end of the base seat, wherein the connection portion is provided with top and bottom surfaces, multiple front sections of the top and bottom surfaces of the connection portion are two front-section surfaces, multiple rear sections of the top and bottom surfaces of the connection portion are provided with two rear-section surfaces and closer to the base seat than the front sections, the rear-section surface of one of the top and bottom surfaces of the connection portion projects much more than the entire-front-section surface of the one of the top and bottom surfaces of the connection portion by a height to form a step between the rear-section surface and the front-section surface of the one of the top and bottom surfaces, each of the top and bottom surfaces is provided with a connection interface, each of the two connection interfaces comprises one row of electrical connection points, the one row of electrical connection points are disposed on one of the rear-section and front-section surfaces, the two rows of electrical connection points are respectively electrically connected to the two sets of circuits of the circuit board, at least one pair of electrical connection points of the two rows of electrical connection points with a same circuit are electrically connected together through the circuit board, and a shape of the connection portion allows one docking electrical connector to be dual-positionally and bidirectionally docked for positioning.

2. The bidirectional duplex electrical connector according to claim 1, wherein each of the other ones of the rear-section and front-section surfaces of the top and bottom surfaces of the connection portion is further provided with at least one grounding electrical connection point.

3. The bidirectional duplex electrical connector according to claim 1, wherein the connection portion is a tongue, top and bottom surfaces of the tongue are the top and bottom surfaces of the connection portion, the two rows of electrical connection points are respectively arranged and exposed, and in flat surface contact with and fixed to the two front-section surfaces, and the two rows of electrical connection points are not depressed from most projecting surfaces of the front sections of the top and bottom surfaces of the connection portion; or wherein the connection portion is a tongue, top and bottom surfaces of the tongue are the top and bottom surfaces of the connection portion, the two rows of electrical connection points are respectively arranged and exposed, and in flat surface contact with and fixed to the two front-section surfaces, the two rows of electrical connection points are not depressed from most projecting surfaces of the front sections of the top and bottom surfaces of the connection portion, and each of the two rear-section surfaces is further provided with at least one grounding rear-section-surface electrical connection point.

4. The bidirectional duplex electrical connector according to claim 3, wherein a front section of the tongue is a thinner plate body, top and bottom surfaces of the thinner body are the two front-section surfaces, a rear section of the tongue is a thicker flat plate body, top and bottom surfaces of the thicker plate body are provided with the two rear-section surfaces, and a side view of the tongue has a convex shape; or wherein the two rows of electrical connection points are formed on two rows of terminals, and the two rows of terminals are embedded into and integrally plastic injection molded with the tongue and the base seat.

5. The bidirectional duplex electrical connector according to claim 1, wherein the circuit board is provided with a safety protection circuit, the safety protection circuit is electrically connected to at least one pair of electrical connection points of the two rows of electrical connection points, and the safety protection circuit is provided with a circuit safety protection device and/or multiple safety circuit electrical elements to achieve circuit safety; or wherein electrical connection points of the two rows of electrical connection points with a same ground circuit and a same power circuit are electrically connected together through the circuit board; or wherein electrical connection points of the two rows of electrical connection points with a same circuit are electrically connected together through the circuit board; or wherein the two rows of electrical connection points are electrical connection points with a same circuit and are electrically connected together through the circuit board; or wherein at least one pair of vertically aligned ones of the two rows of electrical connection points have a same circuit and are electrically connected together through the circuit board; or wherein at least one pair of electrical connection points of the two rows of electrical connection points with a same circuit are arranged reversely.

6. The bidirectional duplex electrical connector according to claim 1, wherein at least one pair of electrical connection points of the two rows of electrical connection points with a same circuit are arranged reversely; or wherein the two rows of electrical connection points are electrical connection points with a same circuit; or wherein the two rows of electrical connection points are electrical connection points with a same circuit and at least one pair of electrical connection points of the two rows of electrical connection points with a same circuit are arranged reversely; or wherein electrical connection points of the two rows of electrical connection points with a same circuit are arranged reversely; or wherein the two rows of electrical connection points are electrical connection points with a same circuit and are arranged reversely.

7. The bidirectional duplex electrical connector according to claim 1, wherein the bidirectional duplex electrical connector further comprises a connection slot disposed on the front end of the base seat, the top and bottom surfaces of the connection portion are disposed within the connection slot, and the connection slot allows the docking electrical connector to be dual-positionally and bidirectionally inserted for positioning; or wherein the bidirectional duplex electrical connector further comprises a connection slot disposed on the front end of the base seat, the top and bottom surfaces of the connection portion are disposed within the connection slot, the connection slot allows the docking electrical connector to be dual-positionally and bidirectionally inserted for positioning, a locking structure is provided, the locking structure is made of a metal material and is disposed on two sides or left and right sides of the connection slot, and the locking structure can lock a locking portion of the docking electrical connector to prevent the docking electrical connector from escaping in a direction opposite to a docking direction.

8. The bidirectional duplex electrical connector according to claim 1, wherein the base seat is provided with a fitting slot, the circuit board is fit with and locks the fitting slot, and the one or multiple rows of bonding points are exposed out of the fitting slot; or wherein a rear section of the base seat is provided with a fitting slot, the circuit board is fit with and locks the fitting slot, the one or multiple rows of bonding points are exposed out of the fitting slot, and the fitting slot covers and rests against top and bottom surfaces and left and right side surfaces of the circuit board; or wherein the base seat is provided with a fitting slot, the circuit board is fit with and locks the fitting slot, the one or multiple rows of bonding points are exposed out of the fitting slot, the fitting slot extends to the connection portion, the circuit board is fit with the connection portion, and the fitting slot covers and rests against top and bottom surfaces and left and right side surfaces of the circuit board.

9. The bidirectional duplex electrical connector according to claim 1, wherein a maximum thickness of the front section of the connection portion is thin and a maximum thickness of the rear section of the connection portion is thicker; or wherein the connection portion and the base seat are integrally formed together; or wherein the rear section of the connection portion and the base seat are integrally formed together; or wherein the connection portion and the base seat are injection molded with a plastic material; or wherein the rear section of the connection portion and the base seat are injection molded with a plastic material.

10. The bidirectional duplex electrical connector according to claim 9, wherein the connection portion is a tongue, top and bottom surfaces of the tongue are the top and bottom surfaces of the connection portion, a thickness of the front section of the connection portion is smaller than 1.0 mm, and a thickness of the rear section of the connection portion is greater than 1.0 mm and smaller than 1.6 mm; or wherein the connection portion is a tongue, top and bottom surfaces of the tongue are the top and bottom surfaces of the connection portion, a thickness of the front section of the connection portion ranges from 0.6 mm to 1.0 mm, and a thickness of the rear section of the connection portion is greater than 1.0 mm and smaller than 1.6 mm.

11. A bidirectional duplex electrical connector, comprising:

a circuit board, wherein the circuit board is provided with two sets of circuits, a rear section of the circuit board is provided with one or multiple rows of bonding points, and the one or multiple rows of bonding points are electrically connected to the two sets of circuits;

a base seat;

a connection portion, wherein the connection portion is connected to and disposed on a front end of the base seat, the connection portion is provided with top and bottom surfaces, each of the top and bottom surfaces is provided with a connection interface, each of the two connection interfaces comprises one row of electrical connection points, the two rows of electrical connection points are respectively electrically connected to the two sets of circuits of the circuit board, at least one pair of electrical connection points of the two rows of electrical connection points with a same circuit are electrically connected together through the circuit board, and a shape of the connection portion allows one docking electrical connector to be dual-positionally and bidirectionally docked for positioning; and a fitting slot provided on the base seat, wherein the circuit board is fit with and locks the fitting slot, and the one or multiple rows of bonding points are exposed out of the fitting slot.

12. The bidirectional duplex electrical connector according to claim 11, wherein the two sets of circuits are respectively disposed on top and bottom surfaces of the circuit board; or wherein the multiple rows of bonding points are two rows of bonding points; or wherein the two sets of circuits are respectively disposed on top and bottom surfaces of the circuit board, the one or multiple rows of bonding points are two rows of bonding pads respectively disposed on the top and bottom surfaces of the circuit board, and the two rows of bonding points are respectively electrically connected to the two sets of circuits.

13. The bidirectional duplex electrical connector according to claim 11, wherein the fitting slot covers and rests against top and bottom surfaces and left and right side surfaces of the circuit board; or wherein the fitting slot is provided on a rear section of the base seat, and the fitting slot covers and rests against top and bottom surfaces and left and right side surfaces of the circuit board; or wherein the fitting slot is formed when the circuit board is embedded into, integrally plastic injection molded with and fixed to the base seat, and the fitting slot covers and rests against top and bottom surfaces and left and right side surfaces of the circuit board.

14. The bidirectional duplex electrical connector according to claim 11, wherein the connection portion is a tongue, top and bottom surfaces of the tongue are the top and bottom surfaces of the connection portion, the two rows of electrical connection points are respectively arranged and exposed, and in flat surface contact with and fixed to and only provided on the top and bottom surfaces of the front section, the fitting slot extends to the tongue, the circuit board is fit with the tongue, and the fitting slot covers and rests against top and bottom surfaces and left and right side surfaces of the circuit board; or wherein the connection portion is a tongue, top and bottom surfaces of the tongue are the top and bottom surfaces of the connection portion, the two rows of electrical connection points are respectively arranged and exposed, and in flat surface contact with and fixed to and only provided on the top and bottom surfaces of the front section, the fitting slot is formed when the circuit board is embedded into and integrally plastic injection molded with the base seat and the tongue, the fitting slot extends to the tongue, the circuit board is fit with the tongue, and the fitting slot covers and rests against top and bottom surfaces and left and right side surfaces of the circuit board.

15. The bidirectional duplex electrical connector according to claim 11, wherein the two rows of electrical connection points are vertically aligned flat contact connection terminals with an equal length; or the two rows of electrical connection points are vertically aligned flat contact connection terminals; or wherein only one of the two connection interfaces is electrically connected to the docking electrical connector.

16. The bidirectional duplex electrical connector according to claim 14, wherein the bidirectional duplex electrical connector further comprises a metal shell covering the tongue and fitting with and resting against top and bottom surfaces and two side surfaces of the base seat to form annular covering and resting; or wherein the bidirectional duplex electrical connector further comprises a metal shell covering the tongue and fitting with and resting against top and bottom surfaces and two side surfaces of the base seat to form annular covering and resting, and a locking structure is provided, wherein the locking structure is integrally disposed on two sides or left and right sides of the metal shell, and the locking structure can lock a locking portion of the docking electrical connector to prevent the docking electrical connector from escaping in a direction opposite to a docking direction.

17. The bidirectional duplex electrical connector according to claim 11, wherein the circuit board is provided with a safety protection circuit, the safety protection circuit is electrically connected to at least one pair of electrical connection points of the two rows of electrical connection points, and the safety protection circuit is provided with a circuit safety protection device and/or multiple safety circuit electrical elements to achieve circuit safety; or wherein electrical connection points of the two rows of electrical connection points with a same ground circuit and a same power circuit are electrically connected together through the circuit board; or wherein electrical connection points of the two rows of electrical connection points with a same circuit are electrically connected together through the circuit board; or wherein the two rows of electrical connection points are electrical connection points with a same circuit and are electrically connected together through the circuit board; or wherein at least one pair of vertically aligned ones of the two rows of electrical connection points have a same circuit and are electrically connected together through the circuit board; or wherein at least one pair of electrical connection points of the two rows of electrical connection points with a same circuit are arranged reversely.

18. The bidirectional duplex electrical connector according to claim 11, wherein the bidirectional duplex electrical connector further comprises a connection slot disposed on the front end of the base seat, the top and bottom surfaces of the connection portion are disposed within the connection slot, and the connection slot allows the docking electrical connector to be dual-positionally and bidirectionally inserted for positioning; or wherein the bidirectional duplex electrical connector further comprises a connection slot disposed on the front end of the base seat, the top and bottom surfaces of the connection portion are disposed within the connection slot, the connection slot allows the docking electrical connector to be dual-positionally and bidirectionally inserted for positioning, a locking structure is provided, the locking structure is made of a metal material and is disposed on two sides or left and right sides of the connection slot, and the locking structure can lock a locking portion of the docking electrical connector to prevent the docking electrical connector from escaping in a direction opposite to a docking direction.

19. The bidirectional duplex electrical connector according to claim 11, wherein a maximum thickness of a front section of the connection portion is thin and a maximum thickness of a rear section of the connection portion is thicker; or wherein the connection portion and the base seat are integrally formed together; or wherein a rear section of the connection portion and the base seat are integrally formed together; or wherein the connection portion and the base seat are injection molded with a plastic material; or wherein a rear section of the connection portion and the base seat are injection molded with a plastic material.

20. The bidirectional duplex electrical connector according to claim 19, wherein the connection portion is a tongue, top and bottom surfaces of the tongue are the top and bottom surfaces of the connection portion, a thickness of the front section of the connection portion is smaller than 1.0 mm, and a thickness of the rear section of the connection portion is greater than 1.0 mm and smaller than 1.6 mm; or wherein the connection portion is a tongue, top and bottom surfaces of the tongue are the top and bottom surfaces of the connection portion, a thickness of the front section of the connection portion ranges from 0.6 mm to 1.0 mm, and a thickness of the rear section of the connection portion is greater than 1.0 mm and smaller than 1.6 mm; or wherein the connection portion is a tongue, and a thickness of the tongue is greater than 1.0 mm and smaller than 1.6 mm.

21. A combination of a bidirectional duplex electrical connector and a docking electrical connector, the combination comprising:

the docking electrical connector provided with an insulation seat and a metal housing covering the insulation seat, wherein a fitting space is provided in the metal housing, the fitting space is provided with a top surface and a bottom surface, one end of the insulation seat is connected to and provided with at least one connection plate having a connection surface forming one of the top surface and the bottom surface of the fitting space, the connection surface is provided with a front section and a rear section, and the rear section of the connection surface is provided with one row of elastically movable connection points, which are elastically movable up and down; and the bidirectional duplex electrical connector, comprising:

a circuit board provided with two sets of circuits, wherein the circuit board is provided with one or multiple rows of bonding points, and the one or multiple rows of bonding points are electrically connected to the two sets of circuits;

a base seat; and a tongue, wherein the tongue is provided on a front end of the base seat, a front section and a rear section of top and bottom surfaces of the tongue are flat surfaces, the circuit board is embedded into, integrally plastic injection molded with and fixed to the tongue and the base seat, the base seat covers and rests against top and bottom surfaces and left and right side surfaces of the circuit board, each of the top and bottom surfaces of the tongue is provided with a connection interface, each of the two connection interfaces comprises one row of electrical connection points, the two rows of electrical connection points are respectively arranged and exposed, and in flat surface contact with and fixed to and only provided on top and bottom flat surfaces of the front section of the tongue, the two rows of electrical connection points are not exposed from the top and bottom flat surfaces of the rear section of the tongue, the two rows of electrical connection points are respectively electrically connected to the two sets of circuits of the circuit board, at least one pair of electrical connection points of the two rows of electrical connection points with a same circuit are electrically connected together through the circuit board, and a shape of the tongue can be dual-positionally and bidirectionally docked with the fitting space of the docking electrical connector for positioning.

22. The combination according to claim 21, wherein a rear section of the circuit board is provided with the one or multiple rows of bonding points; or wherein the two sets of circuits are respectively disposed on top and bottom surfaces of the circuit board; or wherein the multiple rows of bonding points are two rows of bonding points; or wherein the two sets of circuits are respectively disposed on top and bottom surfaces of the circuit board, the one or multiple rows of bonding points are two rows of bonding pads respectively disposed on the top and bottom surfaces of the circuit board, and the two rows of bonding points are respectively electrically connected to the two sets of circuits.

23. The combination according to claim 21, wherein the two rows of electrical connection points are vertically aligned flat contact connection terminals with an equal length; or the two rows of electrical connection points are vertically aligned flat contact connection terminals; or wherein only one of the two connection interfaces is electrically connected to the docking electrical connector.

24. The combination according to claim 21, wherein the bidirectional duplex electrical connector further comprises a metal shell covering the tongue and fitting with and resting against top and bottom surfaces and two side surfaces of the base seat to form annular covering and resting; or wherein the bidirectional duplex electrical connector further comprises a metal shell covering the tongue and fitting with and resting against top and bottom surfaces and two side surfaces of the base seat to form annular covering and resting, and a locking structure is provided, wherein the locking structure is integrally disposed on two sides or left and right sides of the metal shell, and the locking structure can lock a locking portion of the docking electrical connector to prevent the docking electrical connector from escaping in a direction opposite to a docking direction.

25. The combination according to claim 21, wherein the circuit board is provided with a safety protection circuit, the safety protection circuit is electrically connected to at least one pair of electrical connection points of the two rows of electrical connection points, and the safety protection circuit is provided with a circuit safety protection device and/or multiple safety circuit electrical elements to achieve circuit safety; or wherein electrical connection points of the two rows of electrical connection points with a same ground circuit and a same power circuit are electrically connected together through the circuit board; or wherein electrical connection points of the two rows of electrical connection points with a same circuit are electrically connected together through the circuit board; or wherein the two rows of electrical connection points are electrical connection points with a same circuit and are electrically connected together through the circuit board; or wherein at least one pair of electrical connection points of the two rows of electrical connection points with a same circuit are arranged reversely.

26. The combination according to claim 21, wherein the bidirectional duplex electrical connector further comprises a connection slot disposed on the front end of the base seat, the top and bottom surfaces of the tongue are disposed within the connection slot, and the connection slot allows the docking electrical connector to be dual-positionally and bidirectionally inserted for positioning; or wherein the bidirectional duplex electrical connector further comprises a connection slot disposed on the front end of the base seat, the top and bottom surfaces of the tongue are disposed within the connection slot, the connection slot allows the docking electrical connector to be dual-positionally and bidirectionally inserted for positioning, a locking structure is provided, the locking structure is made of a metal material and is disposed on two sides or left and right sides of the connection slot, and the locking structure can lock a locking portion of the docking electrical connector to prevent the docking electrical connector from escaping in a direction opposite to a docking direction.

27. The combination according to claim 21, wherein the tongue covers and rests against top and bottom surfaces and left and right side surfaces of the circuit board.

28. The combination according to claim 21, wherein the base seat is provided with a fitting slot, the circuit board is fit with and locks the fitting slot, and the one or multiple rows of bonding points are exposed out of the fitting slot; or wherein a rear section of the base seat is provided with a fitting slot, the circuit board is fit with and locks the fitting slot, the one or multiple rows of bonding points are exposed out of the fitting slot, and the fitting slot covers and rests against top and bottom surfaces and left and right side surfaces of the circuit board; or wherein the base seat is provided with a fitting slot, the circuit board is fit with and locks the fitting slot, the one or multiple rows of bonding points are exposed out of the fitting slot, the fitting slot extends to the tongue, the circuit board is fit with the connection portion, and the fitting slot covers and rests against top and bottom surfaces and left and right side surfaces of the circuit board.

29. The combination according to claim 21, wherein a maximum thickness of the front section of the tongue is thin and a maximum thickness of the rear section of the tongue is thicker; or wherein the tongue and the base seat are integrally formed together; or wherein the rear section of the tongue and the base seat are integrally formed together; or wherein the tongue and the base seat are injection molded with a plastic material; or wherein the rear section of the tongue and the base seat are injection molded with a plastic material; or wherein the front section of the tongue is a thinner plate body, top and bottom surfaces of the thinner plate body are two front-section surfaces, the rear section of the tongue is a thicker plate body, top and bottom surfaces of the thicker plate body are provided with two rear-section surfaces, and a side view of the tongue forms a convex shape; or wherein the two rows of electrical connection points are formed on two rows of terminals, and the two rows of terminals are embedded into and integrally plastic injection molded with the tongue and the base seat.

30. The combination according to claim 29, wherein a thickness of the front section of the tongue is smaller than 1.0 mm, and a thickness of the rear section of the tongue is greater than 1.0 mm and smaller than 1.6 mm; or wherein a thickness of the front section of the tongue ranges from 0.6 mm to 1.0 mm, and a thickness of the rear section of the tongue is greater than 1.0 mm and smaller than 1.6 mm.

* * * * *